US009451791B2

(12) United States Patent
Sears et al.

(10) Patent No.: US 9,451,791 B2
(45) Date of Patent: Sep. 27, 2016

(54) AEROSOL DELIVERY DEVICE WITH AN ILLUMINATED OUTER SURFACE AND RELATED METHOD

(71) Applicants: R.J. Reynolds Tobacco Company, Winston-Salem, NC (US); Performance Indicator, LLC, Lowell, MA (US)

(72) Inventors: Stephen Benson Sears, Siler City, NC (US); Andries Don Sebastian, Clemmons, NC (US); Frederic Philippe Ampolini, Winston-Salem, NC (US); Dennis Lee Potter, Kernersville, NC (US); Satish Agrawal, Concord, MA (US); M. Glenn Horner, West Roxbury, MA (US)

(73) Assignees: RAI Strategic Holdings, Inc., Winston-Salem, NC (US); Performance Indicator, LLC, Lowell, MA (US)

( * ) Notice: Subject to any disclaimer, the term of this patent is extended or adjusted under 35 U.S.C. 154(b) by 241 days.

(21) Appl. No.: 14/173,266

(22) Filed: Feb. 5, 2014

(65) Prior Publication Data

US 2015/0216233 A1 Aug. 6, 2015

(51) Int. Cl.

*A24F 47/00* (2006.01)
*F21V 33/00* (2006.01)

(Continued)

(52) U.S. Cl.

CPC ..... *A24F 47/008* (2013.01); *F21K 9/52* (2013.01); *F21V 7/22* (2013.01); *F21V 33/004* (2013.01); *F21W 2111/10* (2013.01); *F21Y 2101/02* (2013.01)

(58) Field of Classification Search

CPC ..... A24F 47/00; A24F 47/008; F21V 33/00
See application file for complete search history.

(56) References Cited

U.S. PATENT DOCUMENTS 1,771,366 A 7/1930 Wyss et al.
2,057,353 A 10/1936 Whittemore, Jr.

(Continued)

FOREIGN PATENT DOCUMENTS

AU 276250 7/1965
CA 2 641 869 5/2010

(Continued)

OTHER PUBLICATIONS

RP Photonics Encyclopedia, "*Waveguides*", website visited Feb. 5, 2014 http://www.rp-photonics.com/waveguides.html.

(Continued)

*Primary Examiner* — Karabi Guharay
(74) *Attorney, Agent, or Firm* — Womble Carlyle Sandridge & Rice LLP

(57) ABSTRACT

The present disclosure relates to aerosol delivery devices that may include components configured to convert electrical energy to heat and atomize an aerosol precursor composition. An outer body may at least partially enclose the components. An illumination source may be configured to output electromagnetic radiation. For example, a light emitting diode may output light. A waveguide may be configured to receive the electromagnetic radiation from the illumination source and provide illumination at an outer surface of the outer body. The waveguide may include an energy conversion material configured to alter a wavelength of the electromagnetic radiation outputted by the illumination source to change a color of, or otherwise affect, the illumination. The illumination may also be dynamically adjusted. The waveguide may define the outer body, or the waveguide may be received with a separate outer body. Related methods are also provided.

24 Claims, 16 Drawing Sheets

(51) Int. Cl.

| | |
|---|---|
| ***F21K 99/00*** | (2016.01) |
| ***F21V 7/22*** | (2006.01) |
| *F21Y 101/02* | (2006.01) |
| *F21W 111/10* | (2006.01) |

(56) References Cited

U.S. PATENT DOCUMENTS

| | | | |
|---|---|---|---|
| 2,104,266 | A | 1/1938 | McCormick |
| 2,805,669 | A | 9/1957 | Meriro |
| 3,200,819 | A | 4/1963 | Gilbert |
| 3,316,919 | A | 5/1967 | Green et al. |
| 3,398,754 | A | 8/1968 | Tughan |
| 3,419,015 | A | 12/1968 | Wochnowski |
| 3,424,171 | A | 1/1969 | Rooker |
| 3,476,118 | A | 11/1969 | Luttich |
| 4,054,145 | A | 10/1977 | Berndt et al. |
| 4,131,117 | A | 12/1978 | Kite et al. |
| 4,150,677 | A | 4/1979 | Osborne |
| 4,190,046 | A | 2/1980 | Virag |
| 4,219,032 | A | 8/1980 | Tabatznik et al. |
| 4,259,970 | A | 4/1981 | Green, Jr. |
| 4,284,089 | A | 8/1981 | Ray |
| 4,303,083 | A | 12/1981 | Burruss, Jr. |
| 4,449,541 | A | 5/1984 | Mays et al. |
| 4,506,682 | A | 3/1985 | Muller |
| 4,635,651 | A | 1/1987 | Jacobs |
| 4,674,519 | A | 6/1987 | Keritsis et al. |
| 4,708,151 | A | 11/1987 | Shelar |
| 4,714,082 | A | 12/1987 | Banerjee et al. |
| 4,735,217 | A | 4/1988 | Gerth et al. |
| 4,756,318 | A | 7/1988 | Clearman et al. |
| 4,771,795 | A | 9/1988 | White et al. |
| 4,776,353 | A | 10/1988 | Lilja et al. |
| 4,793,365 | A | 12/1988 | Sensabaugh, Jr. et al. |
| 4,800,903 | A | 1/1989 | Ray et al. |
| 4,819,665 | A | 4/1989 | Roberts et al. |
| 4,821,749 | A | 4/1989 | Toft et al. |
| 4,830,028 | A | 5/1989 | Lawson et al. |
| 4,836,224 | A | 6/1989 | Lawson et al. |
| 4,836,225 | A | 6/1989 | Sudoh |
| 4,848,374 | A | 7/1989 | Chard et al. |
| 4,848,376 | A | 7/1989 | Lilja et al. |
| 4,874,000 | A | 10/1989 | Tamol et al. |
| 4,880,018 | A | 11/1989 | Graves, Jr. et al. |
| 4,887,619 | A | 12/1989 | Burcham, Jr. et al. |
| 4,907,606 | A | 3/1990 | Lilja et al. |
| 4,913,168 | A | 4/1990 | Potter et al. |
| 4,917,119 | A | 4/1990 | Potter et al. |
| 4,917,128 | A | 4/1990 | Clearman et al. |
| 4,922,901 | A | 5/1990 | Brooks et al. |
| 4,924,888 | A | 5/1990 | Perfetti et al. |
| 4,928,714 | A | 5/1990 | Shannon |
| 4,938,236 | A | 7/1990 | Banerjee et al. |
| 4,941,483 | A | 7/1990 | Ridings et al. |
| 4,941,484 | A | 7/1990 | Clapp et al. |
| 4,945,931 | A | 8/1990 | Gori |
| 4,947,874 | A | 8/1990 | Brooks et al. |
| 4,947,875 | A | 8/1990 | Brooks et al. |
| 4,972,854 | A | 11/1990 | Kiernan et al. |
| 4,972,855 | A | 11/1990 | Kuriyama et al. |
| 4,986,286 | A | 1/1991 | Roberts et al. |
| 4,987,906 | A | 1/1991 | Young et al. |
| 4,987,908 | A | 1/1991 | Sprinkel et al. |
| 5,005,593 | A | 4/1991 | Fagg |
| 5,019,122 | A | 5/1991 | Clearman et al. |
| 5,022,416 | A | 6/1991 | Watson |
| 5,042,510 | A | 8/1991 | Curtiss et al. |
| 5,056,537 | A | 10/1991 | Brown et al. |
| 5,060,669 | A | 10/1991 | White et al. |
| 5,060,671 | A | 10/1991 | Counts et al. |
| 5,065,775 | A | 11/1991 | Fagg |
| 5,072,744 | A | 12/1991 | Luke et al. |
| 5,074,319 | A | 12/1991 | White et al. |
| 5,076,296 | A | 12/1991 | Nystrom et al. |
| 5,093,894 | A | 3/1992 | Deevi et al. |
| 5,095,921 | A | 3/1992 | Losee et al. |
| 5,097,850 | A | 3/1992 | Braunshteyn et al. |
| 5,099,862 | A | 3/1992 | White et al. |
| 5,099,864 | A | 3/1992 | Young et al. |
| 5,103,842 | A | 4/1992 | Strang et al. |
| 5,121,757 | A | 6/1992 | White et al. |
| 5,129,409 | A | 7/1992 | White et al. |
| 5,131,415 | A | 7/1992 | Munoz et al. |
| 5,143,097 | A | 9/1992 | Sohn et al. |
| 5,144,962 | A | 9/1992 | Counts et al. |
| 5,146,934 | A | 9/1992 | Deevi et al. |
| 5,154,192 | A | 10/1992 | Sprinkel et al. |
| 5,159,940 | A | 11/1992 | Hayward et al. |
| 5,159,942 | A | 11/1992 | Brinkley et al. |
| 5,179,966 | A | 1/1993 | Losee et al. |
| 5,211,684 | A | 5/1993 | Shannon et al. |
| 5,220,930 | A | 6/1993 | Gentry |
| 5,224,498 | A | 7/1993 | Deevi et al. |
| 5,228,460 | A | 7/1993 | Sprinkel, Jr. et al. |
| 5,230,354 | A | 7/1993 | Smith et al. |
| 5,235,992 | A | 8/1993 | Sensabaugh |
| 5,243,999 | A | 9/1993 | Smith |
| 5,246,018 | A | 9/1993 | Deevi et al. |
| 5,249,586 | A | 10/1993 | Morgan et al. |
| 5,261,424 | A | 11/1993 | Sprinkel, Jr. |
| 5,269,327 | A | 12/1993 | Counts et al. |
| 5,285,798 | A | 2/1994 | Banerjee et al. |
| 5,293,883 | A | 3/1994 | Edwards |
| 5,301,694 | A | 4/1994 | Raymond |
| 5,303,720 | A | 4/1994 | Banerjee et al. |
| 5,318,050 | A | 6/1994 | Gonzalez-Parra et al. |
| 5,322,075 | A | 6/1994 | Deevi et al. |
| 5,322,076 | A | 6/1994 | Brinkley et al. |
| 5,339,838 | A | 8/1994 | Young et al. |
| 5,345,951 | A | 9/1994 | Serrano et al. |
| 5,353,813 | A | 10/1994 | Deevi et al. |
| 5,357,984 | A | 10/1994 | Farrier et al. |
| 5,360,023 | A | 11/1994 | Blakley et al. |
| 5,369,723 | A | 11/1994 | Counts et al. |
| 5,372,148 | A | 12/1994 | McCafferty et al. |
| 5,377,698 | A | 1/1995 | Litzinger et al. |
| 5,388,574 | A | 2/1995 | Ingebrethsen et al. |
| 5,388,594 | A | 2/1995 | Counts et al. |
| 5,408,574 | A | 4/1995 | Deevi et al. |
| 5,435,325 | A | 7/1995 | Clapp et al. |
| 5,445,169 | A | 8/1995 | Brinkley et al. |
| 5,468,266 | A | 11/1995 | Bensalem et al. |
| 5,468,936 | A | 11/1995 | Deevi et al. |
| 5,479,948 | A | 1/1996 | Counts et al. |
| 5,498,850 | A | 3/1996 | Das |
| 5,498,855 | A | 3/1996 | Deevi et al. |
| 5,499,636 | A | 3/1996 | Baggett, Jr. et al. |
| 5,501,237 | A | 3/1996 | Young et al. |
| 5,505,214 | A | 4/1996 | Collins et al. |
| 5,515,842 | A | 5/1996 | Ramseyer et al. |
| 5,530,225 | A | 6/1996 | Hajaligol |
| 5,551,450 | A | 9/1996 | Hemsley |
| 5,551,451 | A | 9/1996 | Riggs et al. |
| 5,564,442 | A | 10/1996 | MacDonald et al. |
| 5,573,692 | A | 11/1996 | Das et al. |
| 5,591,368 | A | 1/1997 | Fleischhauer et al. |
| 5,593,792 | A | 1/1997 | Farrier et al. |
| 5,595,577 | A | 1/1997 | Bensalem et al. |
| 5,596,706 | A | 1/1997 | Sikk et al. |
| 5,611,360 | A | 3/1997 | Tang |
| 5,613,504 | A | 3/1997 | Collins et al. |
| 5,613,505 | A | 3/1997 | Campbell et al. |
| 5,649,552 | A | 7/1997 | Cho et al. |
| 5,649,554 | A | 7/1997 | Sprinkel et al. |
| 5,659,656 | A | 8/1997 | Das |
| 5,665,262 | A | 9/1997 | Hajaligol et al. |
| 5,666,976 | A | 9/1997 | Adams et al. |
| 5,666,977 | A | 9/1997 | Higgins et al. |
| 5,666,978 | A | 9/1997 | Counts et al. |
| 5,687,746 | A | 11/1997 | Rose et al. |
| 5,692,525 | A | 12/1997 | Counts et al. |
| 5,692,526 | A | 12/1997 | Adams et al. |
| 5,708,258 | A | 1/1998 | Counts et al. |
| 5,711,320 | A | 1/1998 | Martin |

(56) References Cited

U.S. PATENT DOCUMENTS 5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,894,841 A 4/1999 Voges
5,915,387 A 6/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White
6,196,218 B1 3/2001 Voges
6,196,219 B1 3/2001 Hess et al.
6,216,706 B1 4/2001 Kumar et al.
6,289,898 B1 9/2001 Fournier et al.
6,349,728 B1 2/2002 Pham
6,357,671 B1 3/2002 Cewers
6,418,938 B1 7/2002 Fleischhauer et al.
6,446,426 B1 9/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,222 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,775,459 B2 8/2010 Martens, III et al.
7,810,505 B2 10/2010 Yang
7,832,410 B2 11/2010 Hon
7,845,359 B2 12/2010 Montaser
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,127,772 B2 3/2012 Montaser
8,156,944 B2 4/2012 Han
8,178,852 B2 5/2012 Kingsley et al.
8,232,533 B2 7/2012 Kingsley et al.
8,314,591 B2 11/2012 Terry et al.
8,365,742 B2 2/2013 Hon
8,375,957 B2 2/2013 Hon
8,393,331 B2 3/2013 Hon
8,402,976 B2 3/2013 Fernando et al.
8,499,766 B1 8/2013 Newton
8,528,569 B1 9/2013 Newton
8,539,959 B1 9/2013 Scatterday
8,550,069 B2 10/2013 Alelov
2002/0146242 A1 10/2002 Vieira
2003/0131859 A1 7/2003 Li et al.
2003/0226837 A1 12/2003 Blake et al.
2004/0020500 A1 2/2004 Wrenn et al.
2004/0118401 A1 6/2004 Smith et al.
2004/0129280 A1 7/2004 Woodson et al.
2004/0149296 A1 8/2004 Rostami et al.
2004/0200488 A1 10/2004 Felter et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0172976 A1 8/2005 Newman et al.
2005/0274390 A1 12/2005 Banerjee et al.
2006/0016453 A1 1/2006 Kim
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0085103 A1 4/2008 Beland et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0065010 A1 3/2009 Shands
2009/0095311 A1 4/2009 Hon
2009/0095312 A1 4/2009 Herbrich et al.
2009/0101930 A1* 4/2009 Li ..... F21K 9/135 257/98
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistila et al.
2010/0307518 A1 12/2010 Wang
2010/0313901 A1 12/2010 Fernando et al.
2011/0005535 A1 1/2011 Xiu

(56) References Cited

U.S. PATENT DOCUMENTS

| | | | |
|---|---|---|---|
| 2011/0011396 | A1 | 1/2011 | Fang |
| 2011/0036363 | A1 | 2/2011 | Urtsev et al. |
| 2011/0036365 | A1 | 2/2011 | Chong et al. |
| 2011/0073121 | A1 | 3/2011 | Levin et al. |
| 2011/0088707 | A1 | 4/2011 | Hajaligol |
| 2011/0094523 | A1 | 4/2011 | Thorens et al. |
| 2011/0120482 | A1 | 5/2011 | Brenneise |
| 2011/0126848 | A1 | 6/2011 | Zuber et al. |
| 2011/0155153 | A1 | 6/2011 | Thorens et al. |
| 2011/0155718 | A1 | 6/2011 | Greim et al. |
| 2011/0162663 | A1 | 7/2011 | Bryman |
| 2011/0168194 | A1 | 7/2011 | Hon |
| 2011/0180082 | A1 | 7/2011 | Banerjee et al. |
| 2011/0265806 | A1 | 11/2011 | Alarcon et al. |
| 2011/0309157 | A1 | 12/2011 | Yang et al. |
| 2012/0042885 | A1 | 2/2012 | Stone et al. |
| 2012/0060853 | A1 | 3/2012 | Robinson et al. |
| 2012/0080613 | A1 | 4/2012 | Kingsley et al. |
| 2012/0111347 | A1 | 5/2012 | Hon |
| 2012/0132643 | A1 | 5/2012 | Choi et al. |
| 2012/0227752 | A1 | 9/2012 | Alelov |
| 2012/0231464 | A1 | 9/2012 | Yu et al. |
| 2012/0260927 | A1 | 10/2012 | Liu |
| 2012/0279512 | A1 | 11/2012 | Hon |
| 2012/0318882 | A1 | 12/2012 | Abehasera |
| 2013/0037041 | A1 | 2/2013 | Worm et al. |
| 2013/0056013 | A1 | 3/2013 | Terry et al. |
| 2013/0081625 | A1 | 4/2013 | Rustad et al. |
| 2013/0081642 | A1 | 4/2013 | Safari |
| 2013/0088853 | A1 | 4/2013 | Kingsley et al. |
| 2013/0192619 | A1 | 8/2013 | Tucker et al. |
| 2013/0306084 | A1 | 11/2013 | Flick |
| 2013/0319439 | A1 | 12/2013 | Gorelick et al. |
| 2013/0340750 | A1 | 12/2013 | Thorens et al. |
| 2013/0340775 | A1 | 12/2013 | Juster et al. |
| 2014/0000638 | A1 | 1/2014 | Sebastian et al. |
| 2014/0060554 | A1 | 3/2014 | Collett et al. |
| 2014/0060555 | A1 | 3/2014 | Chang et al. |
| 2014/0096781 | A1 | 4/2014 | Sears et al. |
| 2014/0096782 | A1 | 4/2014 | Ampolini et al. |

FOREIGN PATENT DOCUMENTS

| | | |
|---|---|---|
| CA | 2 752 255 | 8/2010 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| GB | 1444461 | 7/1976 |
| GB | 2469850 | 11/2010 |
| WF | 2 468 116 | 6/2012 |
| WO | WO 86/02528 | 5/1986 |
| WO | WO 97/48293 | 12/1997 |
| WO | WO 02/37990 | 5/2002 |
| WO | WO 2004/043175 | 5/2004 |
| WO | WO 2005/099494 | 10/2005 |
| WO | WO 2007/078273 | 7/2007 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2011/081558 | 7/2011 |
| WO | WO 2012/072762 | 6/2012 |
| WO | WO 2012/100523 | 8/2012 |
| WO | WO 2013/089551 | 6/2013 |
| WO | WO 2013/138384 | 9/2013 |
| WO | WO 2013/141907 | 9/2013 |

OTHER PUBLICATIONS

AIPIA Active & Intelligent Packaging Industry Association, "*Transparent Aluminum Foil from Nano Plastic Layer*", website visited Feb. 5, 2014 http://www.aipia.info/news_260_transparent-aluminium-foil-from-nano-plastic-layer.php.

International Search Report and Written Opinion of the International Searching Authority for corresponding International Application No. PCT/US2015/014194 mailed Jun. 2, 2015.

* cited by examiner

AEROSOL DELIVERY DEVICE WITH AN ILLUMINATED OUTER SURFACE AND RELATED METHOD

FIELD OF THE DISCLOSURE

The present disclosure relates to an aerosol delivery device, and more particularly to providing illumination at an outer surface of the aerosol delivery device. The aerosol delivery device may be configured to heat an aerosol precursor, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. patent application Ser. No. 13/432,406, filed Mar. 28, 2012, U.S. patent application Ser. No. 13/536,438, filed Jun. 28, 2012, U.S. patent application Ser. No. 13/602,871, filed Sep. 4, 2012, and U.S. patent application Ser. No. 13/647,000, filed Oct. 8, 2012, which are incorporated herein by reference.

Certain tobacco products that have employed electrical energy to produce heat for smoke or aerosol formation, and in particular, certain products that have been referred to as electronic cigarette products, have been commercially available throughout the world. Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; COHITA™, COLIBRI™, ELITE CLASSIC™, MAGNUM™, PHANTOM™ and SENSE™ by Epuffer® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; GREEN SMOKE® by Green Smoke Inc. USA; GREENARETTE™ by Greenarette LLC; HALLIGAN™, HENDU™, JET™, MAXXQ™, PINK™ and PITBULL™ by Smoke Stik®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC and VUSE® by R. J. Reynolds Vapor Company. Yet other electrically powered aerosol delivery devices, and in particular those devices that have been characterized as so-called electronic cigarettes, have been marketed under the tradenames BLU™; COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP® and SOUTH BEACH SMOKE™.

However, it may be desirable to distinguish aerosol delivery devices from that of competing products, for example, by providing aerosol delivery devices with distinguishing visual characteristics. Further, it may be desirable to configure the aerosol delivery devices to provide visual feedback or information relating to use thereof.

BRIEF SUMMARY OF THE DISCLOSURE

In one aspect an aerosol delivery device is provided. The aerosol delivery device may include one or more components configured to atomize an aerosol precursor composition. The aerosol delivery device may be an electronic smoking article configured to convert electrical energy into heat to atomize the aerosol precursor composition. The aerosol delivery device may also include an outer body at least partially enclosing the components. Further, the aerosol delivery device may include one or more illumination sources configured to output an electromagnetic radiation. The aerosol delivery device may additionally include a waveguide configured to receive the electromagnetic radiation from the one or more illumination sources and provide illumination at an outer surface of the outer body.

In some embodiments the outer body may comprise the waveguide. The waveguide may include a reflective layer configured to reflect an ambient light. In another embodiment the waveguide may be received within the outer body. In this regard, the outer body may define one or more apertures extending therethrough to the outer surface.

In some embodiments the waveguide may include a roughened portion configured to direct the electromagnetic radiation toward the outer surface. The waveguide may include an energy conversion material configured to receive the electromagnetic radiation and emit a secondary electromagnetic radiation defining a wavelength differing from a wavelength of the electromagnetic radiation. The waveguide may include a plurality of sections, each of the sections having one of the illumination sources associated therewith.

In some embodiments the outer body is the outer body of a control body and the components include an electrical power source and a control component, the control component being configured to selectively direct an atomizer to atomize an aerosol precursor. In another embodiment the outer body is the outer body of a cartridge and the components include a reservoir substrate configured to hold an aerosol precursor composition and an atomizer configured to produce heat. Further, at least one of the waveguide and the one or more illumination sources may be configured to adjust illumination of the outer surface of the outer body based on at least one of an electrical power source level, an aerosol precursor level, a temperature, an ambient light level, and a detected draw.

In an additional aspect, a method for illuminating an aerosol delivery device is provided. The method may include providing an aerosol delivery device. The aerosol delivery device may include one or more components configured to atomize an aerosol precursor composition, an outer body at least partially enclosing the components, one or more illumination sources, and a waveguide. The method may further include outputting an electromagnetic radiation with the one or more illumination sources. Also, the method may include directing the electromagnetic radiation through the waveguide. The method may additionally include providing illumination at an outer surface of the outer body.

In some embodiments the outer body is defined by the waveguide and the method may additionally include reflecting an ambient light with a reflective layer of the waveguide. In another embodiment the waveguide may be received within the outer body and providing illumination at the outer surface of the body may include directing the electromagnetic radiation toward one or more apertures defined in the outer body.

In some embodiments directing the electromagnetic radiation through the waveguide may include directing the electromagnetic radiation to a roughened portion of the waveguide. Further, directing the electromagnetic radiation through the waveguide may include directing the electromagnetic radiation to an energy conversion material configured to emit a secondary electromagnetic radiation defining a wavelength differing from a wavelength of the electromagnetic radiation. Additionally, outputting the electromagnetic radiation may include selectively outputting the electromagnetic radiation at a plurality of sections of the waveguide from a respective one of the illumination sources.

In some embodiments providing illumination at the outer surface of the outer body may include providing illumination at the outer surface of a control body, wherein the components comprise an electrical power source and a control component, the control component being configured to selectively direct an atomizer to atomize an aerosol precursor. In another embodiment providing illumination at the outer surface of the outer body may include providing illumination at the outer surface of a cartridge, wherein the components comprise a reservoir substrate configured to hold an aerosol precursor composition and an atomizer configured to produce heat. The method may further comprise adjusting illumination of the outer surface of the outer body based on at least one of an electrical power source level, an aerosol precursor level, a temperature, an ambient light level, and a detected draw.

BRIEF DESCRIPTION OF THE FIGURES

Figure 1:
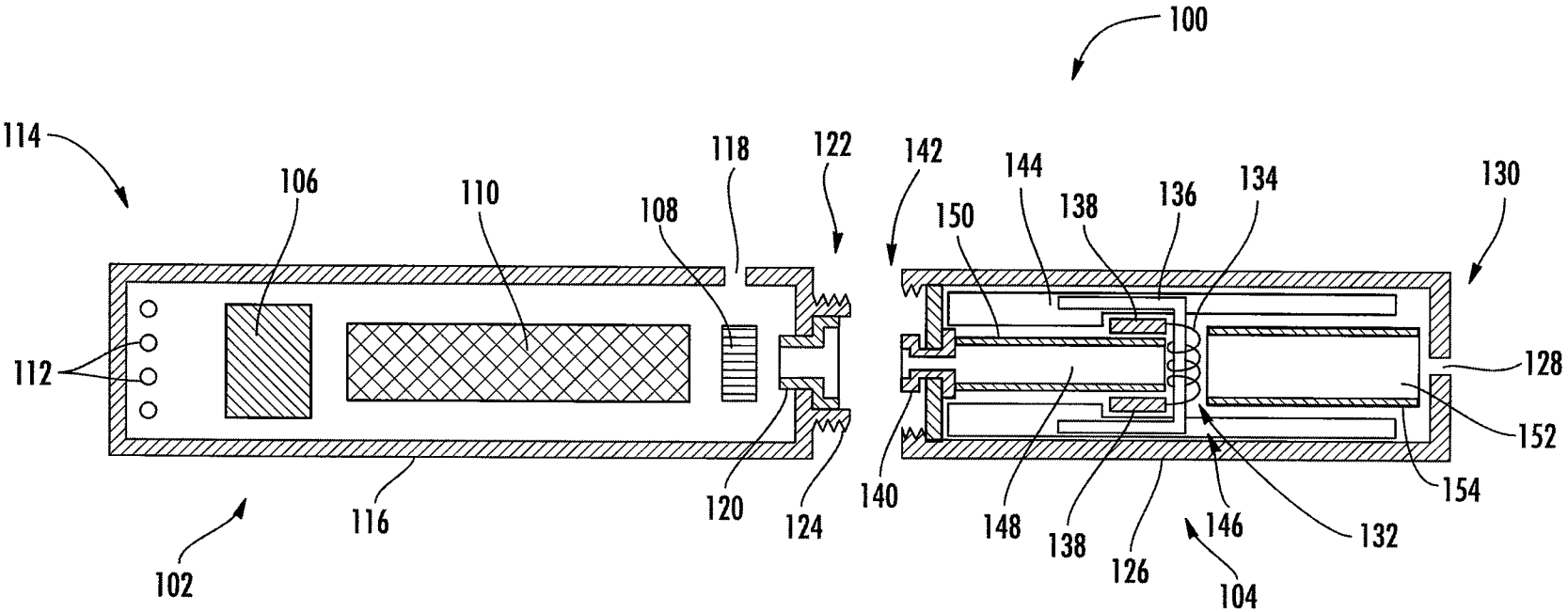
Figure 2:
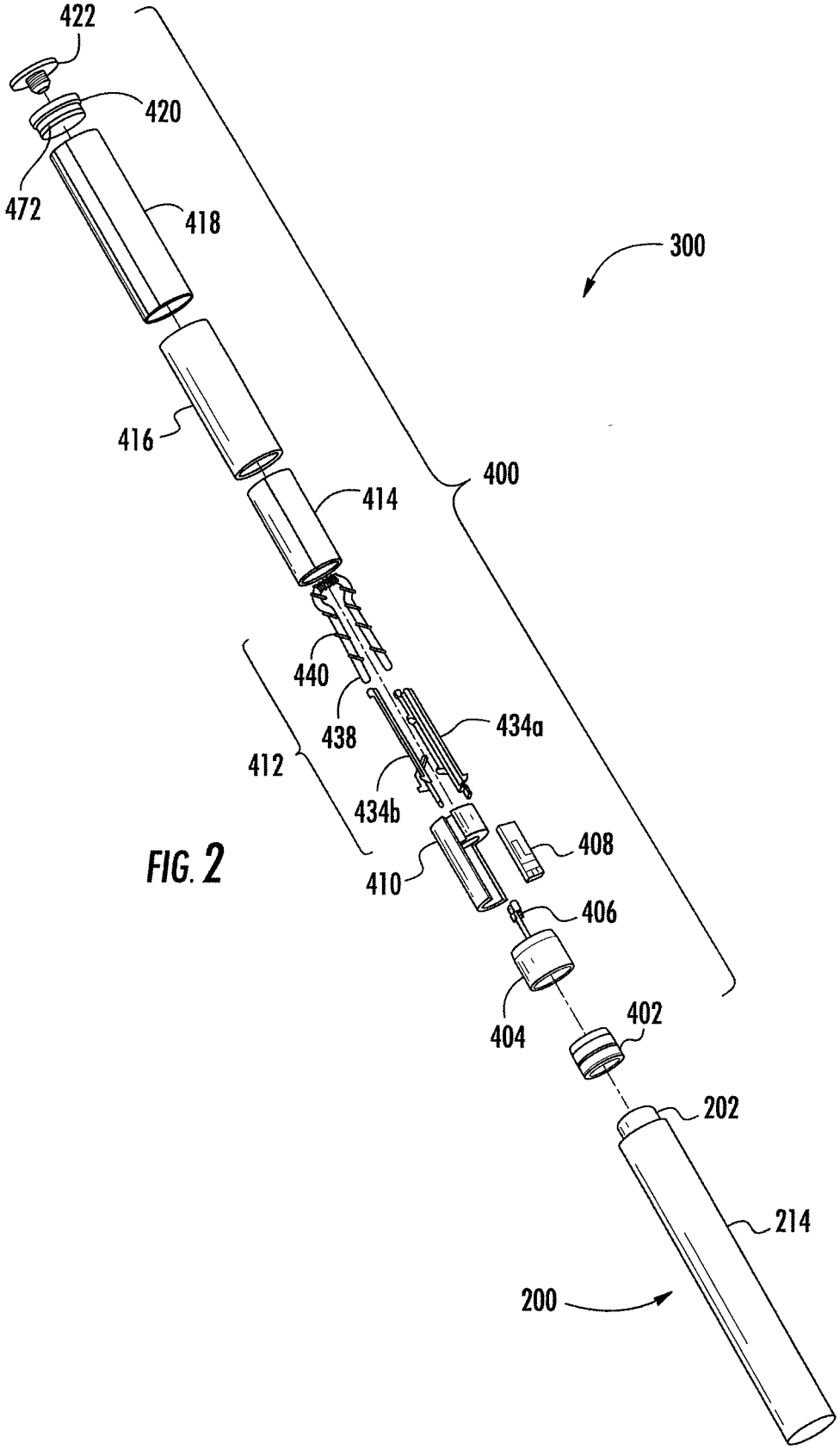
Figure 3:
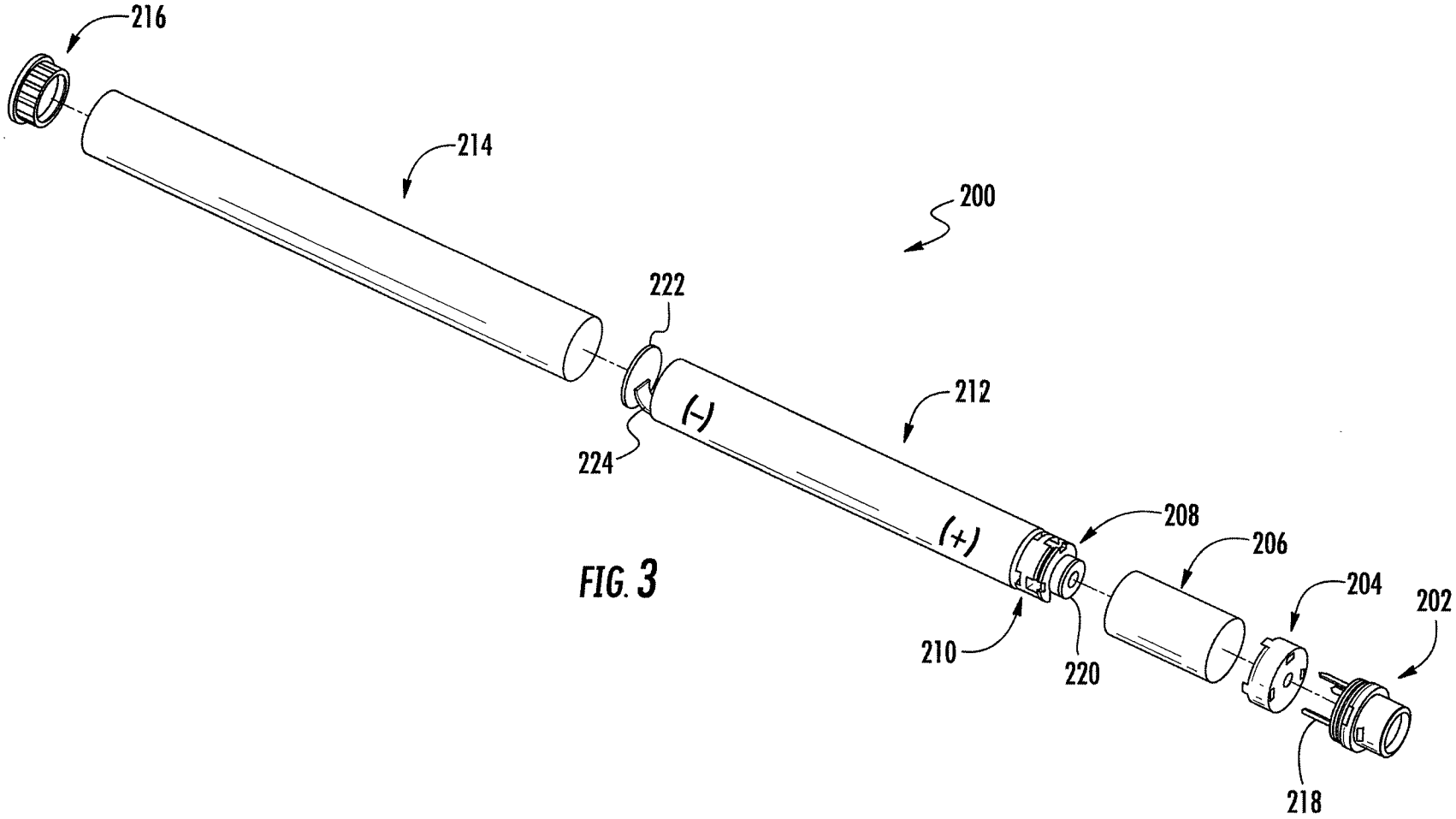
Figure 4:
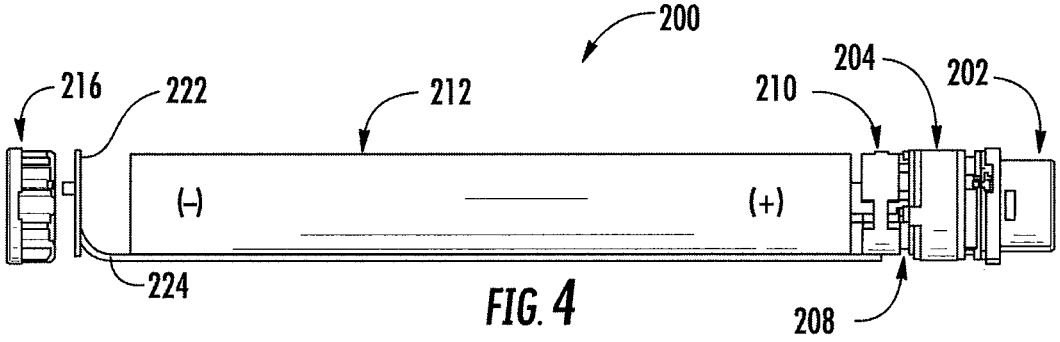
Figure 5:
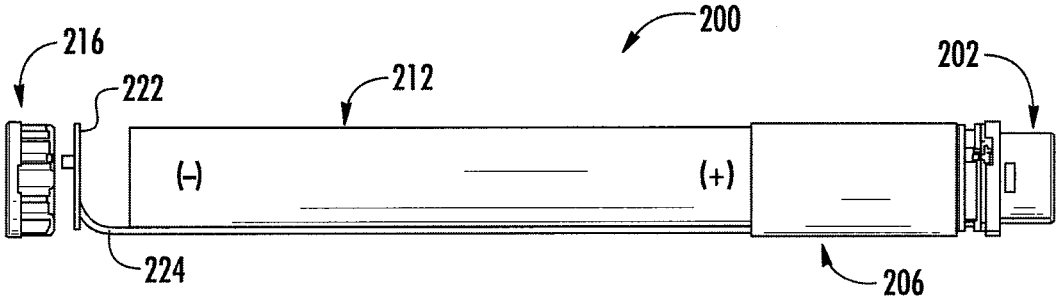
Figure 6:
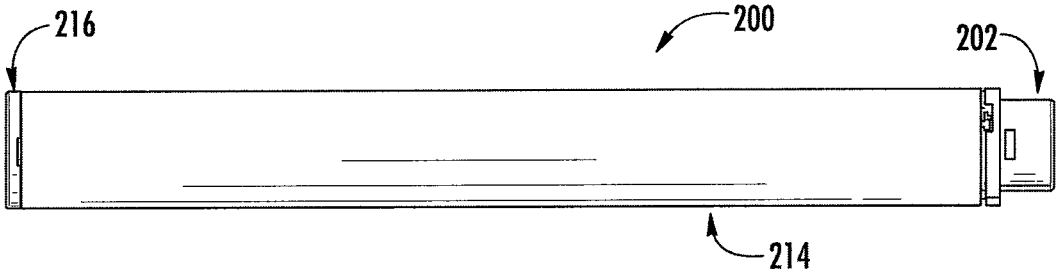
Figure 7:
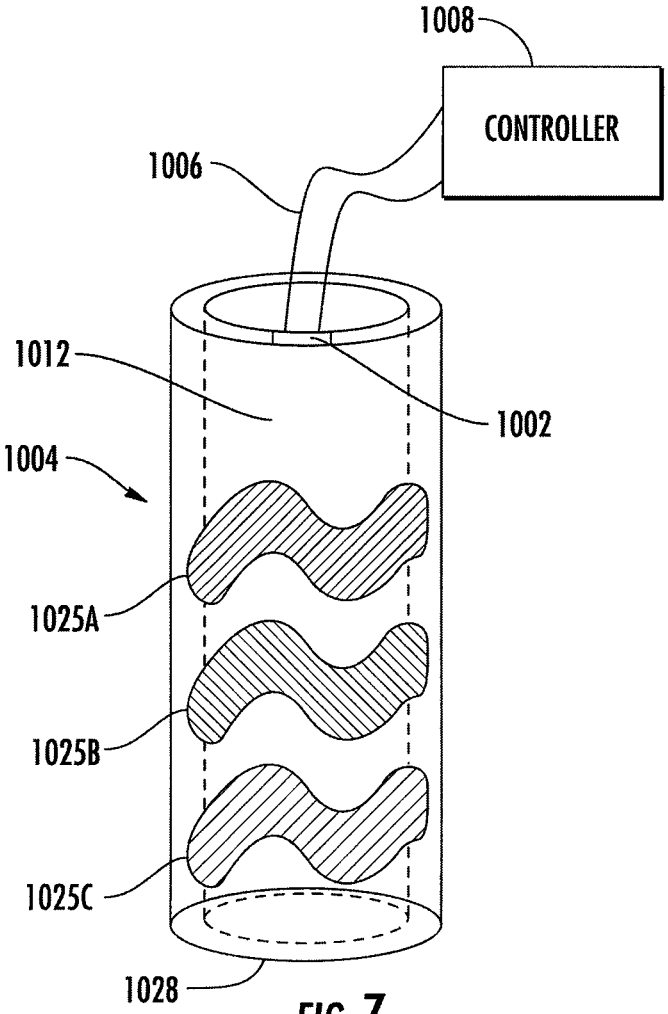
Figure 8:
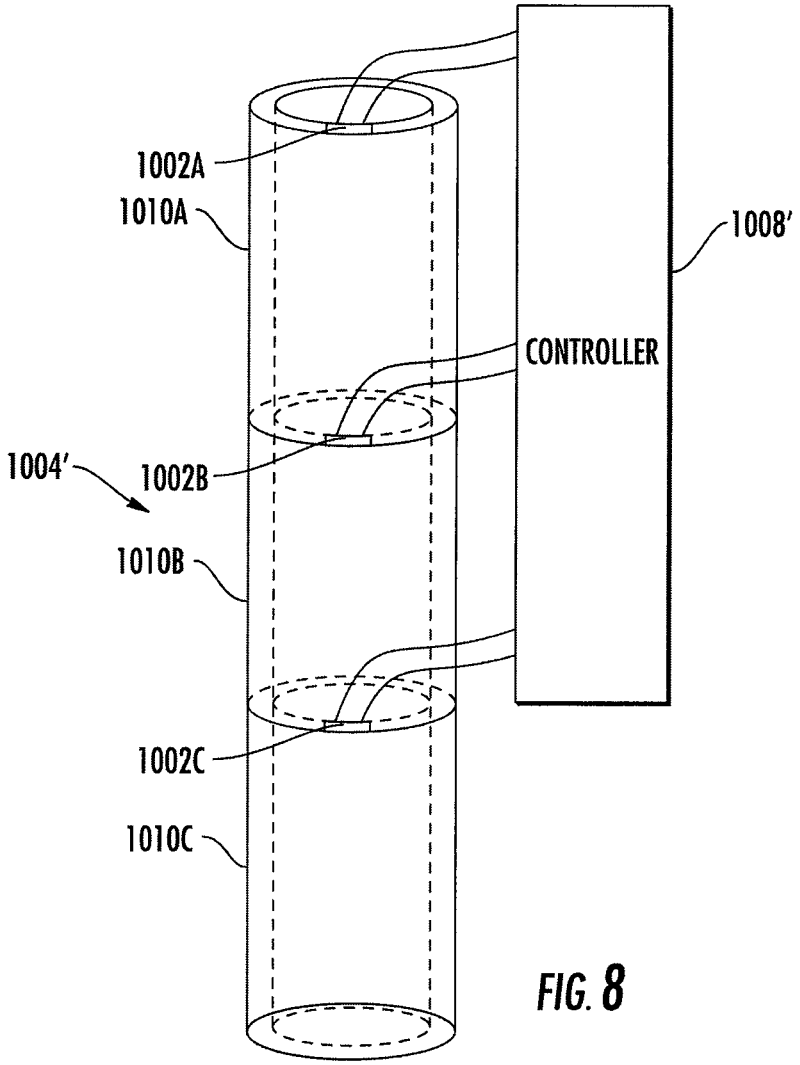
Figure 9:
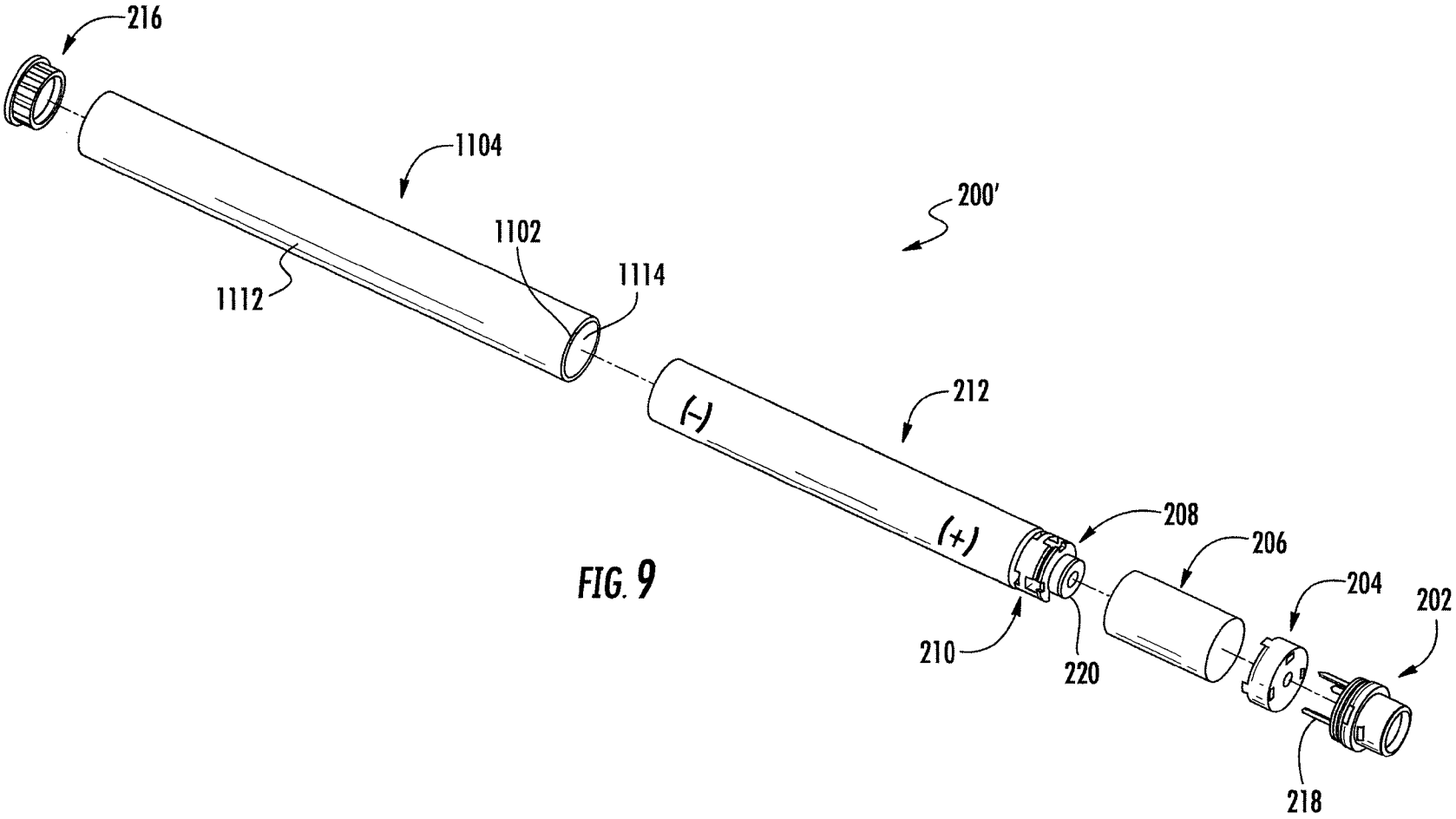
Figure 10:
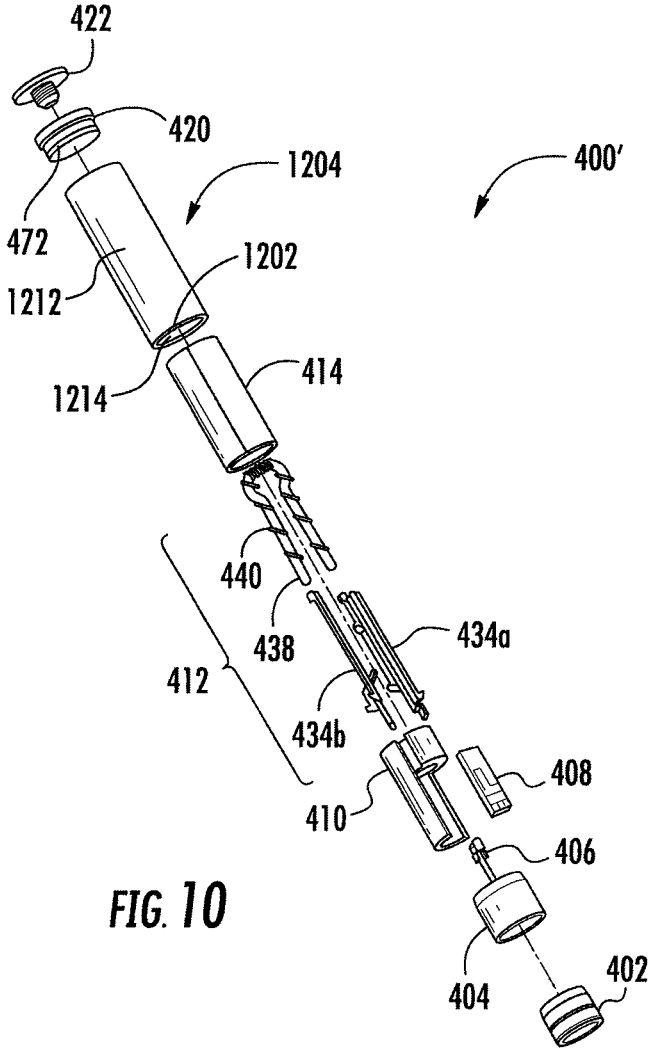
Figure 11:
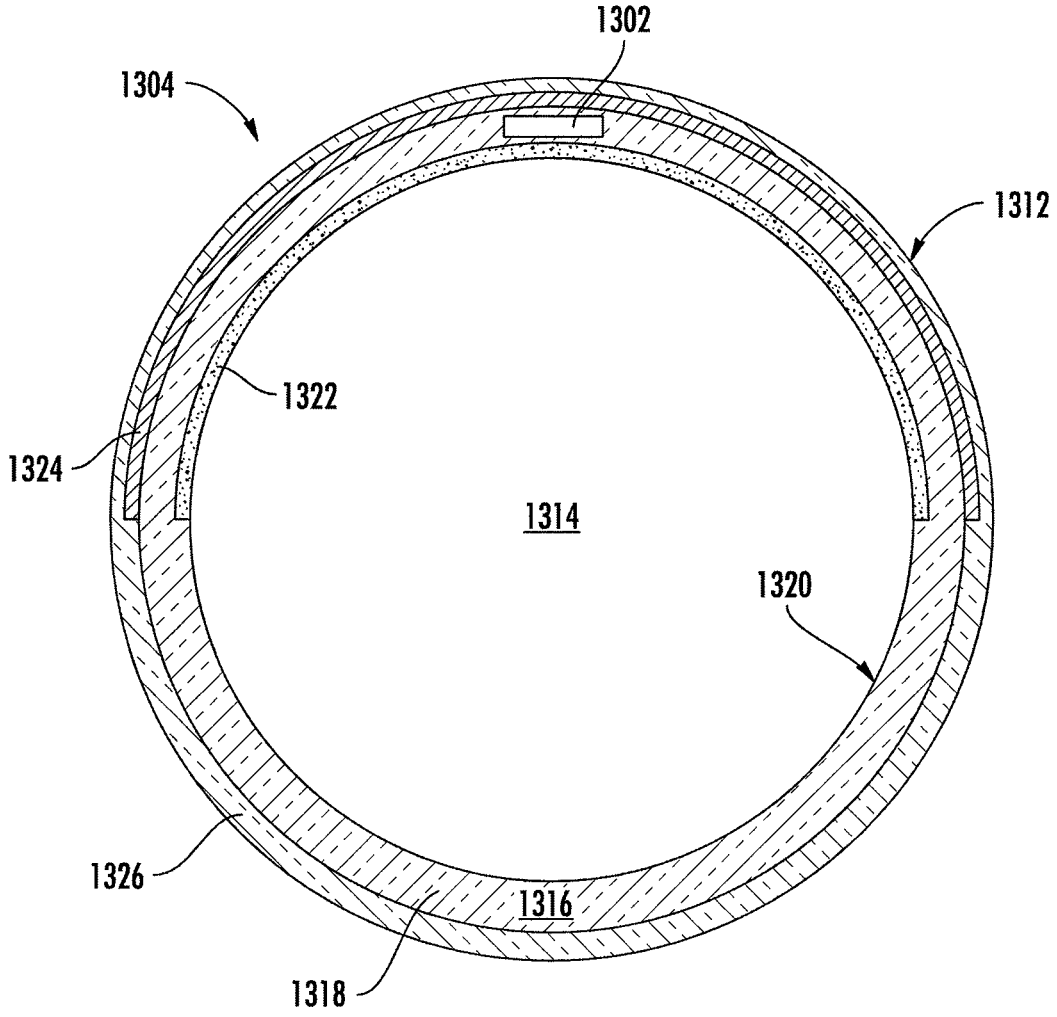
Figure 12:
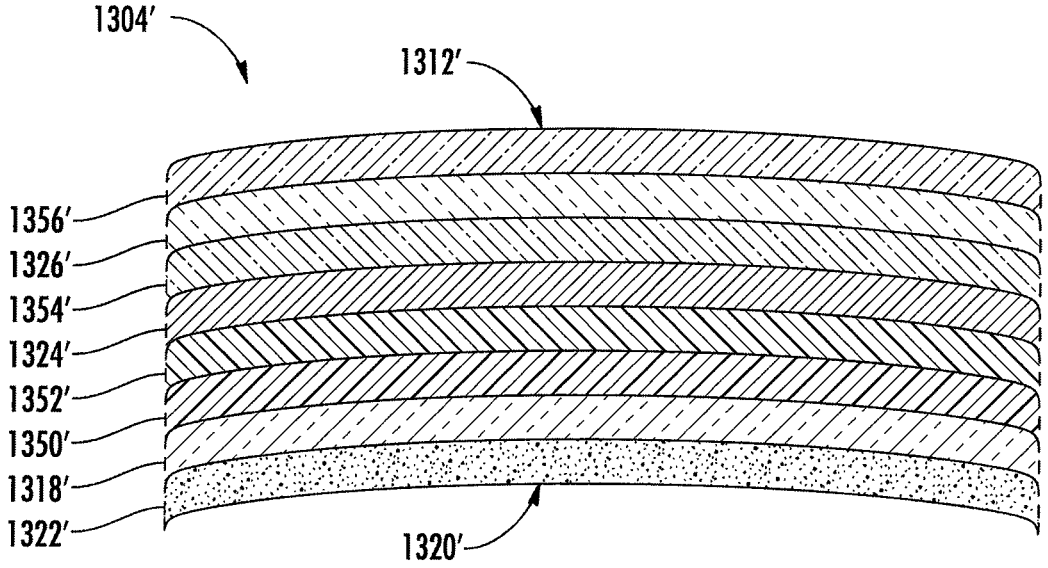
Figure 13:
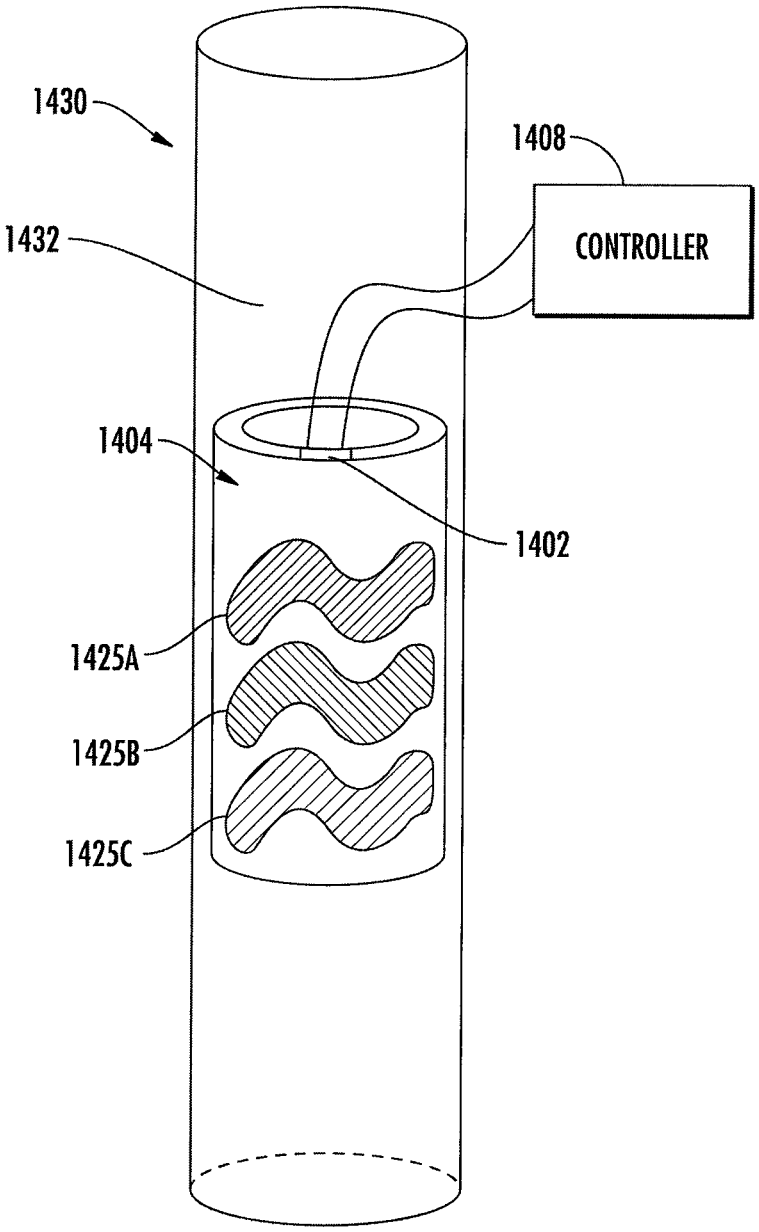
Figure 14:
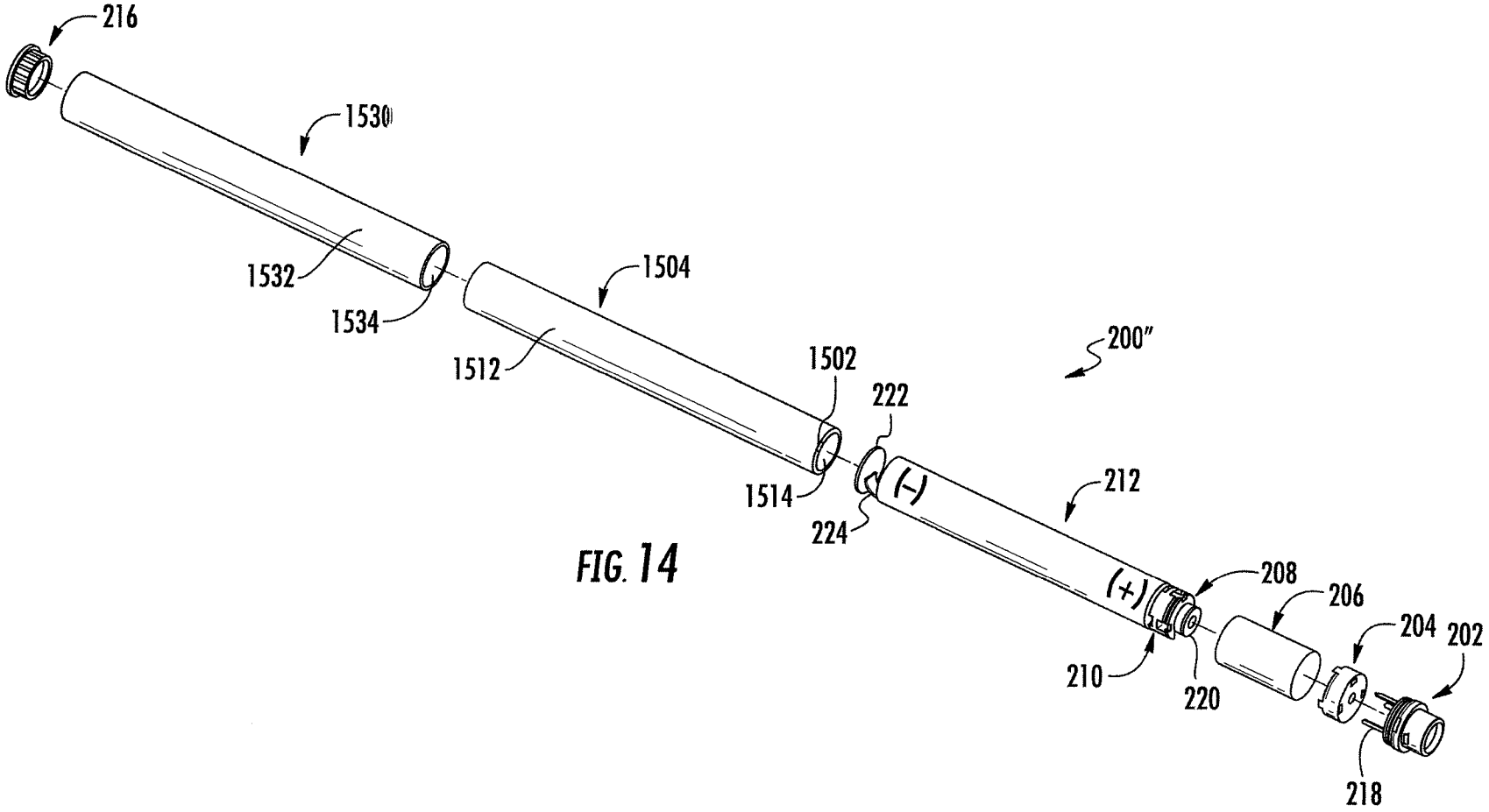
Figure 15:
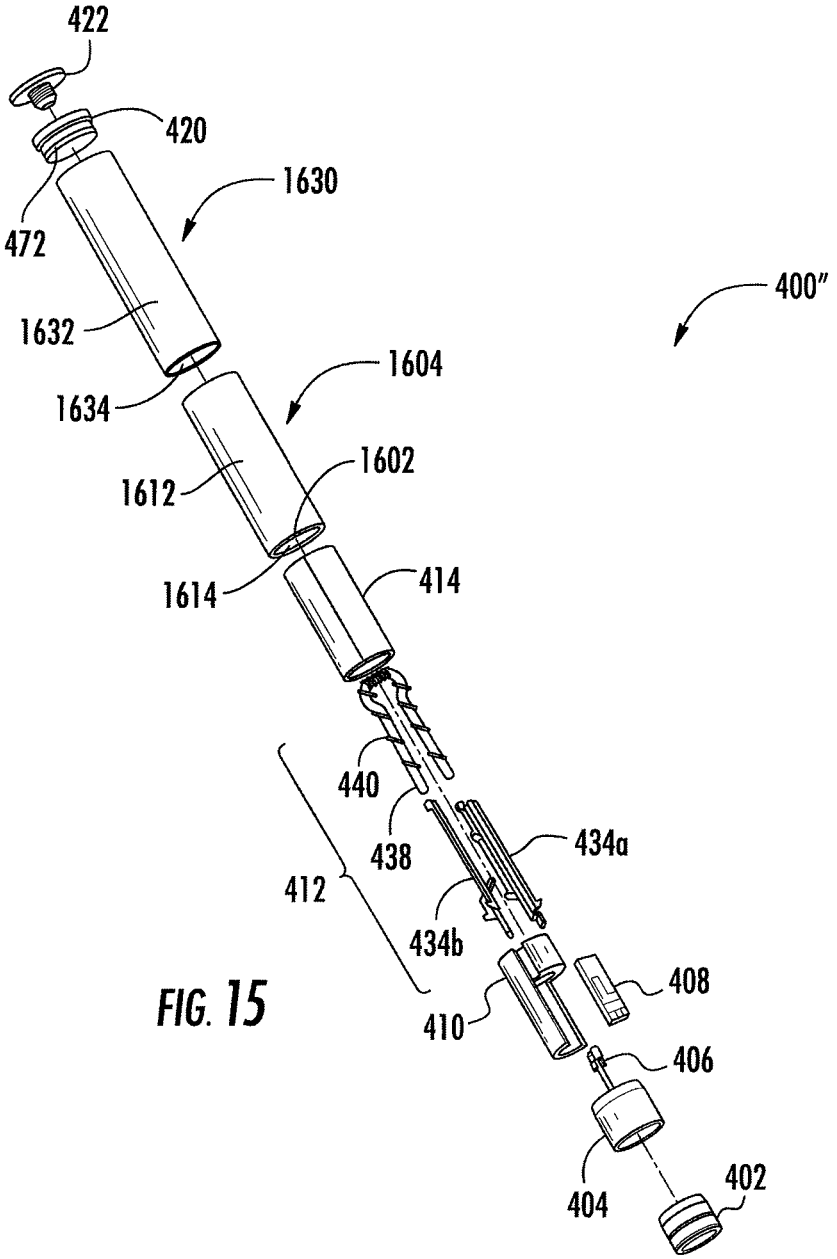
Figure 16:
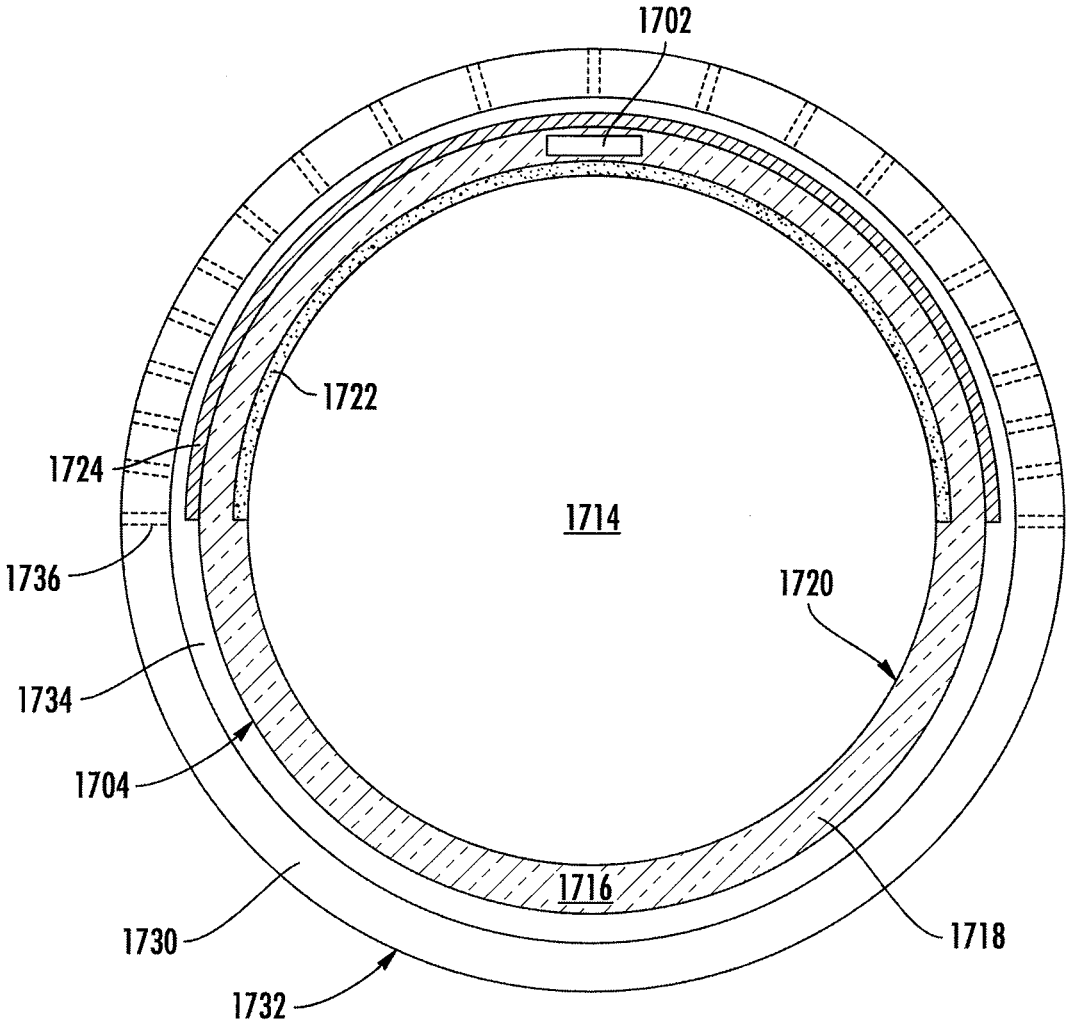
Figure 17:
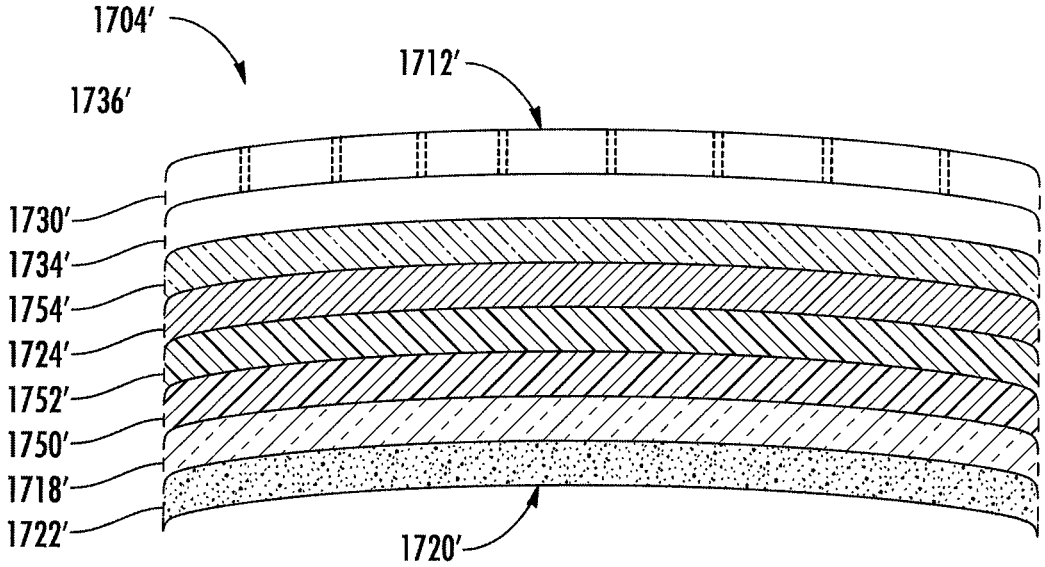
Figure 18:
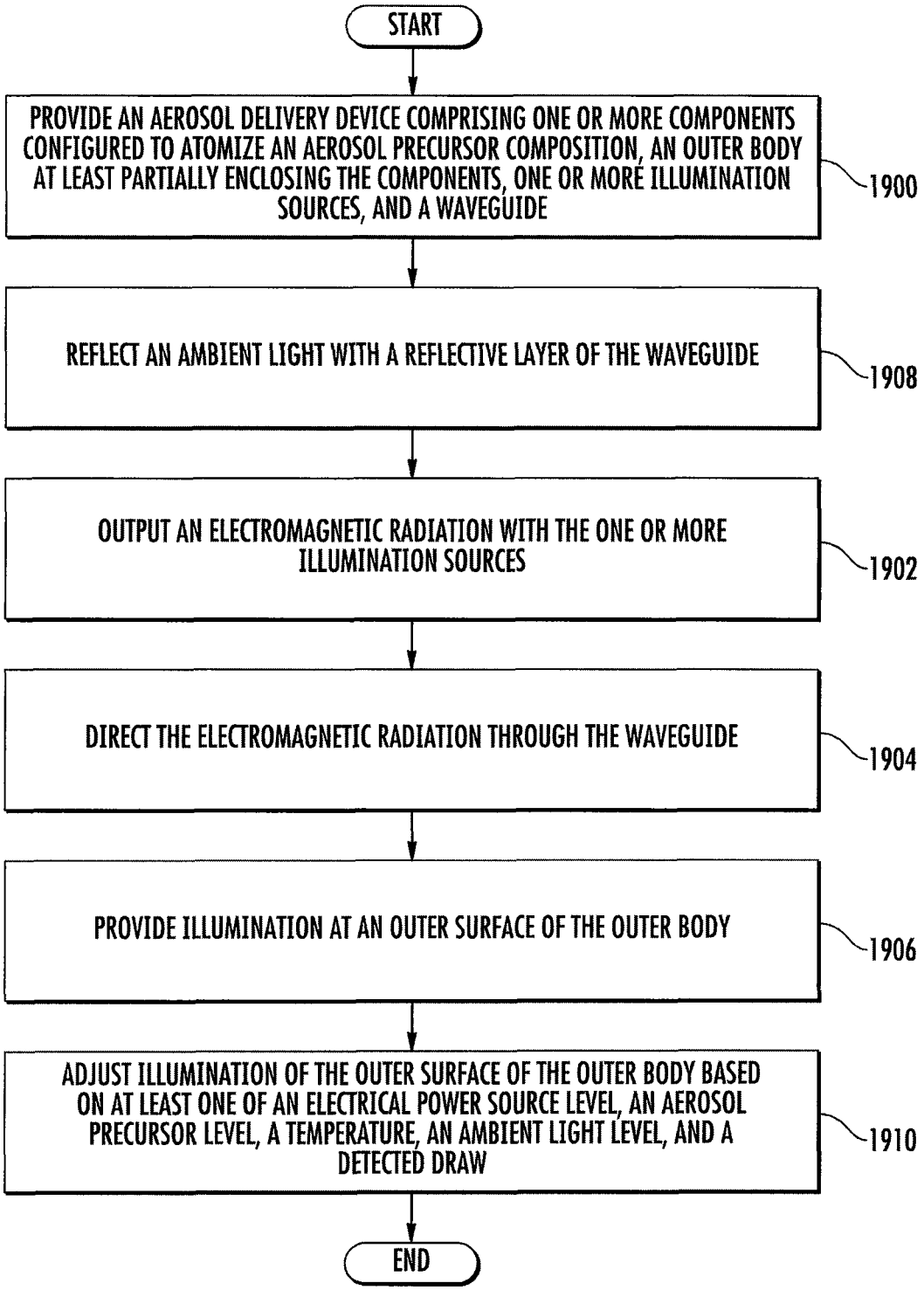

Having thus described the disclosure in the foregoing general terms, reference will now be made to the accompanying drawings, which are not necessarily drawn to scale, and wherein:

FIG. 1 illustrates a sectional view through an aerosol delivery device comprising a control body and a cartridge including an atomizer according to an example embodiment of the present disclosure;

FIG. 2 illustrates a partially exploded view of an aerosol delivery device including a control body in an assembled configuration and a cartridge in an exploded configuration, the cartridge comprising a base shipping plug, a base, a control component terminal, an electronic control component, a flow tube, an atomizer, a reservoir substrate, an outer body, a label, a mouthpiece, and a mouthpiece shipping plug according to an example embodiment of the present disclosure;

FIG. 3 illustrates an exploded view of a control body of an aerosol delivery device according to an example embodiment of the present disclosure;

FIG. 4 illustrates the control body of FIG. 3 in a partially assembled configuration with an adhesive member and an outer body removed for clarity purposes;

FIG. 5 illustrates the control body of FIG. 3 in a partially assembled configuration with outer body removed for clarity purposes;

FIG. 6 illustrates the control body of FIG. 3 in an assembled configuration;

FIG. 7 illustrates a perspective view of a waveguide with an illumination source and a controller according to an example embodiment of the present disclosure;

FIG. 8 illustrates a perspective view of a multi-section waveguide including multiple illumination sources and a controller according to an example embodiment of the present disclosure;

FIG. 9 illustrates an exploded view of a control body of an aerosol delivery device including an outer body comprising a waveguide according to an example embodiment of the present disclosure;

FIG. 10 illustrates an exploded view of a control body of an aerosol delivery device including an outer body comprising a waveguide according to an example embodiment of the present disclosure;

FIG. 11 illustrates an end view of an outer body comprising a waveguide according to an example embodiment of the present disclosure;

FIG. 12 illustrates a schematic enlarged end view of a waveguide including additional layers according to an example embodiment of the present disclosure;

FIG. 13 illustrates a perspective view of a waveguide received within an outer body with an illumination source and a controller according to an example embodiment of the present disclosure;

FIG. 14 illustrates an exploded view of a control body of an aerosol delivery device including a waveguide received within an outer body according to an example embodiment of the present disclosure;

FIG. 15 illustrates an exploded view of a control body of an aerosol delivery device including a waveguide received within an outer body according to an example embodiment of the present disclosure;

FIG. 16 illustrates an end view of a waveguide received within an outer body according to an example embodiment of the present disclosure;

FIG. 17 illustrates a schematic enlarged end view of a waveguide including an outer body and additional layers according to an example embodiment of the present disclosure; and FIG. 18 schematically illustrates a method for illuminating an aerosol delivery device according to an example embodiment of the present disclosure.

DETAILED DESCRIPTION OF PREFERRED EMBODIMENTS

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural variations unless the context clearly dictates otherwise.

The present disclosure provides descriptions of mechanisms, components, features, and methods configured to dynamically change a visual characteristic in response to feedback. While the mechanisms are generally described herein in terms of embodiments associated with aerosol delivery devices such as so-called "e-cigarettes," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods configured to provide for illumination disclosed herein are discussed in terms of embodiments relating to aerosol delivery mechanisms by way of example only, and may be embodied and used in various other products and methods.

In this regard, the present disclosure provides descriptions of aerosol delivery devices that use electrical energy to heat a material (preferably without combusting the material to any significant degree) to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article or device. The aerosol delivery device may not produce smoke in the sense of the aerosol resulting from by-products of combustion or pyrolysis of tobacco, but rather, that the article or device may yield vapors (including vapors within aerosols that can be considered to be visible aerosols that might be considered to be described as smoke-like) resulting from volatilization or vaporization of certain components of the article or device. In highly preferred embodiments, aerosol delivery devices may incorporate tobacco and/or components derived from tobacco.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer body or shell. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary shell; or the elongated body can be formed of two or more separable pieces. For example, an aerosol delivery device can comprise an elongated shell or body that can be substantially tubular in shape and, as such, resemble the shape of a conventional cigarette or cigar. In one embodiment, all of the components of the aerosol delivery device are contained within one outer body or shell. Alternatively, an aerosol delivery device can comprise two or more shells that are joined and are separable. For example, an aerosol delivery device can possess at one end a control body comprising an outer body or shell containing one or more reusable components (e.g., a rechargeable battery and various electronics for controlling the operation of that article), and at the other end and removably attached thereto an outer body or shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various aerosol delivery device designs and component arrangements can be appreciated upon consideration of the commercially available electronic aerosol delivery devices, such as those representative products listed in the background art section of the present disclosure.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow from the power source to other components of the article), a heater or heat generation component (e.g., an electrical resistance heating element or component commonly referred to as an "atomizer"), and an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the article such that aerosol generated can be withdrawn therefrom upon draw). Exemplary formulations for aerosol precursor materials that may be used according to the present disclosure are described in U.S. Pat. Pub. No. 2013/0008457 to Zheng et al., the disclosure of which is incorporated herein by reference in its entirety.

Alignment of the components within the aerosol delivery device can vary. In specific embodiments, the aerosol precursor composition can be located near an end of the article (e.g., within a cartridge, which in certain circumstances can be replaceable and disposable), which may be proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various aerosol delivery device components can be appreciated upon consideration of the commercially available electronic aerosol delivery devices, such as those representative products listed in the background art section of the present disclosure.

An aerosol delivery device incorporates a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the aerosol delivery device so that the aerosol delivery device can be easily handled; and additionally, a preferred power source is of a sufficiently light weight to not detract from a desirable smoking experience.

One example embodiment of an aerosol delivery device 100 is provided in FIG. 1. As seen in the cross-section illustrated therein, the aerosol delivery device 100 can comprise a control body 102 and a cartridge 104 that can be permanently or detachably aligned in a functioning relationship. Although a threaded engagement is illustrated in FIG. 1, it is understood that further means of engagement may be employed, such as a press-fit engagement, interference fit, a magnetic engagement, or the like.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. Further, in some embodiments the cartridge may comprise a single-use cartridge, as disclosed in U.S. patent application Ser. No. 13/603,612, filed Sep. 5, 2012, which is incorporated herein by reference in its entirety.

In the exemplified embodiment, the control body 102 includes a control component 106, a flow sensor 108, and a battery 110, which can be variably aligned, and can include a plurality of indicators 112 at a distal end 114 of an outer body 116. The indicators 112 can be provided in varying numbers and can take on different shapes and can even be an opening in the body (such as for release of sound when such indicators are present).

An air intake 118 may be positioned in the outer body 116 of the control body 102. A coupler 120 also is included at the proximal attachment end 122 of the control body 102 and may extend into a control body projection 124 to allow for ease of electrical connection with an atomizer or a component thereof, such as a resistive heating element (described below) when the cartridge 104 is attached to the control body. Although the air intake 118 is illustrated as being provided in the outer body 116, in another embodiment the air intake may be provided in a coupler as described, for example, in U.S. patent application Ser. No. 13/841,233; Filed Mar. 15, 2013.

The cartridge 104 includes an outer body 126 with a mouth opening 128 at a mouthend 130 thereof to allow passage of air and entrained vapor (i.e., the components of the aerosol precursor composition in an inhalable form) from the cartridge to a consumer during draw on the aerosol delivery device 100. The aerosol delivery device 100 may be substantially rod-like or substantially tubular shaped or substantially cylindrically shaped in some embodiments.

The cartridge 104 further includes an atomizer 132 comprising a resistive heating element 134 (e.g., a wire coil) configured to produce heat and a liquid transport element 136 (e.g., a wick) configured to transport a liquid. Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), and ceramic (e.g., a positive temperature coefficient ceramic). Further to the above, representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

Electrically conductive heater terminals 138 (e.g., positive and negative terminals) at the opposing ends of the heating element 134 are configured to direct current flow through the heating element and configured for attachment to the appropriate wiring or circuit (not illustrated) to form an electrical connection of the heating element with the battery 110 when the cartridge 104 is connected to the control body 102. Specifically, a plug 140 may be positioned at a distal attachment end 142 of the cartridge 104. When the cartridge 104 is connected to the control body 102, the plug 140 engages the coupler 120 to form an electrical connection such that current controllably flows from the battery 110, through the coupler and plug, and to the heating element 134. The outer body 126 of the cartridge 104 can continue across the distal attachment end 142 such that this end of the cartridge is substantially closed with the plug 140 protruding therefrom.

A reservoir may utilize a liquid transport element to transport an aerosol precursor composition to an aerosolization zone. One such example is shown in FIG. 1. As seen therein, in one embodiment the cartridge 104 includes a reservoir layer 144 comprising layers of nonwoven fibers formed into the shape of a tube encircling the interior of the outer body 126 of the cartridge. An aerosol precursor composition is retained in the reservoir layer 144. Liquid components, for example, can be sorptively retained by the reservoir layer 144. The reservoir layer 144 is in fluid connection with a liquid transport element 136. The liquid transport element 136 transports the aerosol precursor composition stored in the reservoir layer 144 via capillary action to an aerosolization zone 146 of the cartridge 104. As illustrated, the liquid transport element 136 is in direct contact with the heating element 134 that is in the form of a metal wire coil in this embodiment.

It is understood that an aerosol delivery device that can be manufactured according to the present disclosure can encompass a variety of combinations of components useful in forming an electronic aerosol delivery device. Reference is made for example to the reservoir and heater system for controllable delivery of multiple aerosolizable materials in an electronic smoking article disclosed in U.S. patent application Ser. No. 13/536,438, filed Jun. 28, 2012, which is incorporated herein by reference in its entirety. Further, U.S. patent application Ser. No. 13/602,871, filed Sep. 4, 2012, discloses an electronic smoking article including a microheater, and which is incorporated herein by reference in its entirety.

In another embodiment substantially the entirety of the cartridge may be formed from one or more carbon materials, which may provide advantages in terms of biodegradability and absence of wires. In this regard, the heating element may comprise a carbon foam, the reservoir may comprise carbonized fabric, and graphite may be employed to form an electrical connection with the battery and controller. Such carbon cartridge may be combined with one or more elements as described herein for providing illumination of the cartridge in some embodiments. An example embodiment of a carbon-based cartridge is provided in U.S. patent application Ser. No. 13/432,406; filed Mar. 28, 2012, which is incorporated herein by reference in its entirety.

In use, when a user draws on the article 100, the heating element 134 is activated (e.g., such as via a puff sensor), and the components for the aerosol precursor composition are vaporized in the aerosolization zone 146. Drawing upon the mouthend 130 of the article 100 causes ambient air to enter the air intake 118 and pass through the central opening in the coupler 120 and the central opening in the plug 140. In the cartridge 104, the drawn air passes through an air passage 148 in an air passage tube 150 and combines with the formed vapor in the aerosolization zone 146 to form an aerosol. The aerosol is whisked away from the aerosolization zone 146, passes through an air passage 152 in an air passage tube 154, and out the mouth opening 128 in the mouthend 130 of the article 100.

The various components of an aerosol delivery device according to the present disclosure can be chosen from components described in the art and commercially available. Examples of batteries that can be used according to the disclosure are described in U.S. Pat. App. Pub. No. 2010/0028766, the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers that can be useful in the present aerosol delivery device, are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

The aerosol precursor, which may also be referred to as an aerosol precursor composition or a vapor precursor composition, can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Still further components can be utilized in the aerosol delivery device of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. App. Pub. No. 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. App. Pub. Nos. 2006/0196518 and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; WO 2010/091593 to Hon; WO 2013/089551 to Foo; and U.S. patent application Ser. No. 13/841,233, filed Mar. 15, 2013, each of which is incorporated herein by reference in its entirety. A variety of the materials disclosed by the foregoing documents may be incorporated into the present devices in various embodiments, and all of the foregoing disclosures are incorporated herein by reference in their entireties.

FIG. 2 illustrates a partially exploded view of an aerosol delivery device 300 including a control body 200 and a cartridge 400. The control body 200 is illustrated in an assembled configuration. Details with respect to the components and functionality of the control component 200 are provided below. Briefly, however, the control body 200 may comprise a coupler 202 and an outer body 214.

The cartridge 400 is illustrated in an exploded configuration in FIG. 2. As illustrated, the cartridge 400 may comprise a base shipping plug 402, a base 404, a control component terminal 406, an electronic control component 408, a flow tube 410, an atomizer 412, a reservoir substrate 414, an outer body 416, a label 418, a mouthpiece 420, and a mouthpiece shipping plug 422 according to an example embodiment of the present disclosure. The atomizer 412 may comprise a first heater terminal 434*a* and a second heater terminal 434*b*, a liquid transport element 438 and a heating element 440. The components of the cartridge 400 may be substantially similar to those included in the aerosol delivery device 100 of FIG. 1 or self-explanatory based on the name thereof. Accordingly, a detailed explanation of each of the components will not be repeated hereinafter. However, the flow tube 410, which is not included in the aerosol delivery device 100 of FIG. 1, may be configured to direct a flow of air received through the base 404 to the heating element 440 of the atomizer 412.

Additionally, in some embodiments, the heating element 440 may comprise a wire defining a plurality of coils wound about the liquid transport element 438. In some embodiments the heating element 440 may be formed by winding the wire about the liquid transport element 438 as described in U.S. patent application Ser. No. 13/708,381, filed Dec. 7, 2012, which is incorporated herein by reference in its entirety. Further, in some embodiments the wire may define a variable coil spacing, as described in U.S. patent application Ser. No. 13/827,994, filed Mar. 14, 2013, which is incorporated herein by reference in its entirety. However, various other embodiments of methods may be employed to form the heating element 440, and various other embodiments of heating elements may be employed in the atomizer 412. For example, a stamped heater element may be employed in the atomizer, as described in U.S. patent application Ser. No. 13/842,125, filed Mar. 15, 2013, which is incorporated herein by reference in its entirety. Further, the reservoir substrate 414 may be configured to hold an aerosol precursor composition. The aerosol precursor composition may comprise a variety of components including, by way of example, glycerin, nicotine, tobacco, tobacco extract, and/or flavorants. Various components that may be included in the aerosol precursor composition are described in U.S. Pat. No. 7,726,320 to Robinson et al., which is incorporated herein by reference. Various other details with respect to embodiments of cartridges including anti-rotation connectors are provided in U.S. patent application Ser. No. 13/840,264, filed Mar. 15, 2013, which is incorporated herein by reference in its entirety. Further, various examples of electronic control components and functions performed thereby are described in U.S. patent application Ser. No. 13/647,000, filed Oct. 8, 2012, which is incorporated herein by reference in its entirety.

Various other details with respect to the components that may be included in the cartridge 400, are provided, for example, in U.S. patent application Ser. No. 13/840,264, filed Mar. 15, 2013, which is incorporated herein by reference in its entirety. In this regard, FIG. 7 thereof illustrates an enlarged exploded view of a base and a control component terminal; FIG. 8 thereof illustrates an enlarged perspective view of the base and the control component terminal in an assembled configuration; FIG. 9 thereof illustrates an enlarged perspective view of the base, the control component terminal, an electronic control component, and heater terminals of an atomizer in an assembled configuration; FIG. 10 thereof illustrates an enlarged perspective view of the base, the atomizer, and the control component in an assembled configuration; FIG. 11 thereof illustrates an opposing perspective view of the assembly of FIG. 10 thereof; FIG. 12 thereof illustrates an enlarged perspective view of the base, the atomizer, the flow tube, and the reservoir substrate in an assembled configuration; FIG. 13 thereof illustrates a perspective view of the base and an outer body in an assembled configuration; FIG. 14 thereof illustrates a perspective view of a cartridge in an assembled configuration; FIG. 15 thereof illustrates a first partial perspective view of the cartridge of FIG. 14 thereof and a coupler for a control body; FIG. 16 thereof illustrates an opposing second partial perspective view of the cartridge of FIG. 14 thereof and the coupler of FIG. 11 thereof; FIG. 17 thereof illustrates a perspective view of a cartridge including a base with an anti-rotation mechanism; FIG. 18 thereof illustrates a perspective view of a control body including a coupler with an anti-rotation mechanism; FIG. 19 thereof illustrates alignment of the cartridge of FIG. 17 with the control body of FIG. 18; FIG. 3 thereof illustrates an aerosol delivery device comprising the cartridge of FIG. 17 thereof and the control body of FIG. 18 thereof with a modified view through the aerosol delivery device illustrating the engagement of the anti-rotation mechanism of the cartridge with the anti-rotation mechanism of the connector body; FIG. 4 thereof illustrates a perspective view of a base with an anti-rotation mechanism; FIG. 5 thereof illustrates a perspective view of a coupler with an anti-rotation mechanism; and FIG. 6 thereof illustrates a sectional view through the base of FIG. 4 thereof and the coupler of FIG. 5 thereof in an engaged configuration.

Note that the various embodiments of components described above in the cited references and/or included in commercially available aerosol delivery devices may be employed in embodiments of the cartridges described herein. Note further that some of the portions of the cartridge 400 illustrated in FIG. 2 are optional. In this regard, by way of example, the cartridge 400 may not include the flow tube 410, the control component terminal 406, and/or the electronic control component 408 in some embodiments.

FIG. 3 illustrates an exploded view of the control body 200 of the aerosol delivery device 300 of FIG. 2 according to an example embodiment of the present disclosure. Some of the components of the control body 200 are shared with the control body illustrated in FIG. 1 and described above, and hence discussion with respect to these components is limited for purposes of brevity. As illustrated, the control body 200 may comprise a coupler (e.g., the coupler 202), a sealing member 204, an adhesive member 206 (e.g., KAPTON® tape), a flow sensor 220, a control component 208, a spacer 210, an electrical power source 212 (e.g., a battery), a circuit board with a light emitting diode (LED) component 222, a connector circuit 224, an outer body 214, and an end cap 216.

The coupler 202 may be configured to couple to the cartridge 400. The coupler 202 may include control body terminals 218 extending therefrom which may extend through the sealing member 204 and engage one or both of the control component 208 and the electrical power source 212. The control component 208 may be a printed circuit board including a microcontroller. The flow sensor 220 may be coupled to the control component 208 or may be a separate element. The LED component 222 can be in communication with the control component 208 through the connector circuit 224 and illuminate, for example, during a user drawing on a cartridge coupled to the coupler 202, as detected by the flow sensor 220. The end cap 216 may be adapted to make visible the LED illumination thereunder provided by the LED component 222.

FIGS. 4-6 illustrate the control body 200 in various states of assembly. More particularly, FIG. 4 illustrates the control body 200 with the adhesive member 206 and the outer body 214 removed for clarity purposes. FIG. 5 illustrates the control body 200 with the outer body 214 removed for clarity purposes. FIG. 6 illustrates the control body in a fully-assembled configuration.

As noted above, in some embodiments the control body 200 may include an LED component 222 configured to illuminate an end of the control body. For example, the LED component may illuminate during use of the aerosol delivery device to simulate the lit end of a smoking article. However, it may be desirable to illuminate other or additional portions of an aerosol delivery device.

In this regard, FIG. 7 illustrates an illumination source 1002 and a waveguide 1004 according to an example embodiment of the present disclosure. The illumination source 1002 is configured to output electromagnetic radiation. The illumination source 1002 may be coupled to, or embedded in the waveguide 1004, such that the electromagnetic radiation is directed into and through the waveguide. In one embodiment the electromagnetic radiation may comprise visible light. However, the illumination source 1002 may additionally or alternatively output electromagnetic radiation outside of the visible spectrum, such as ultraviolet or infrared radiation, in some embodiments.

In one example embodiment, the illumination source 1002 may comprise an LED. However, various other illumination sources may be employed such as a laser or a conventional light bulb. A plurality of leads 1006 or other connections may be configured to connect the illumination source 1002 to a controller 1008. The controller 1008 may be configured to direct the illumination source 1002 to output electromagnetic radiation in certain specified situations and in response to certain stimuli, as discussed below.

The waveguide 1004 may be provided as a single section, as illustrated in FIG. 7. Alternatively, as illustrated in FIG. 8, a waveguide 1004' may include a plurality of sections 1010A-C. Each of the sections 1010A-C includes a respective illumination source 1002A-C associated therewith. In one embodiment the sections 1010A-C may be integrally formed with the illumination sources 1002A-C embedded therein or otherwise coupled thereto at locations therealong. Alternatively, the sections 1010A-C may be separate pieces with the illumination sources 1002A-C respectively coupled thereto. In some embodiments the separate sections 1010A-C may be coupled to one another during assembly of the waveguide 1004'. Regardless of the particular implementation of the multi-section waveguide 1004', a controller 1008' therefor may selectively direct the illumination sources 1002A-C to output the electromagnetic radiation at the respective sections 1010A-C thereof. Thus, the sections 1010A-C of the waveguide 1004' may be independently illuminated.

In general, the waveguides disclosed herein may be configured to receive electromagnetic radiation from the one or more illumination sources and provide illumination at an outer surface of an outer body of the aerosol delivery device associated therewith. The outer body of the aerosol delivery device may be configured to at least partially enclose one or more components of the aerosol delivery device. For example, the outer body may be configured to at least partially enclose components configured to atomize an aerosol precursor composition.

In one embodiment the waveguide may comprise the outer body of an aerosol delivery device. In other words, the waveguide may itself serve as the outer body of all or a portion of an aerosol delivery device, rather than a component separate therefrom. For example, FIG. 9 illustrates an exploded view of an embodiment of a control body 200' comprising features and components of the control body 200 described above and illustrated in FIGS. 3-6. However, instead of the outer body 214, the control body 200' may include a waveguide 1104 and at least one illumination source 1102. Thus, the waveguide 1104 may receive electromagnetic radiation from the illumination source 1102 and provide illumination at an outer surface 1112 thereof.

The waveguide 1104 may also at least partially enclose components configured to atomize an aerosol precursor. In this regard, the waveguide 1104 may define a cavity 1114 configured to at least partially enclose the flow sensor 220, the control component 208, and the electrical power source 212. Note that the LED component 222 and the connector circuit 224 are not included in the embodiment of the control body 200' illustrated in FIG. 9. In this regard, the waveguide 1104 may be configured to provide illumination at the end cap 216 or other portion(s) of the control body 200' proximate the end cap. For example, an end of the waveguide 1104 distal from the illumination source 1102 may be exposed such that light directed thereto is visible. However, in an alternate embodiment the control body 200' may include the LED component 222 and the connector circuit 224.

In an additional embodiment, the waveguide may comprise the outer body of a cartridge of an aerosol delivery device, in addition to or instead of the waveguide comprising the outer body of the control body. In this regard, FIG. 10 illustrates an exploded view of a cartridge 400' comprising features and components of the cartridge 400 described above and illustrated in FIG. 2. However, instead of the outer body 416, the cartridge 400' may include a waveguide 1204 and at least one illumination source 1202. Thus, the waveguide 1204 may receive electromagnetic radiation from the illumination source 1202 and provide illumination an outer surface 1212 thereof. Note that the embodiment of the cartridge 400' illustrated in FIG. 10 does not include the label 418. Accordingly, illumination of the outer surface 1212 of the waveguide 1204 may be visible. However, in other embodiments the cartridge may include the label, and the label may be translucent or transparent, or the label may include gaps or holes at locations at which the cartridge is illuminated. The waveguide 1204 may define a cavity 1214 configured to at least partially enclose components configured to atomize an aerosol precursor. In this regard, the waveguide 1204 may at least partially enclose the electronic control component 408, the flow tube 410, the atomizer 412, and the reservoir substrate 414.

An end view of an embodiment of a waveguide 1304 configured to define an outer body of all or a portion of an aerosol device is illustrated in FIG. 11. The end view of the waveguide 1304 may be substantially similar to an end view of waveguides 1104, 1204 employed in the control body 200' and cartridge 400' illustrated in FIGS. 9 and 10. The waveguide 1304 may be configured to receive electromagnetic radiation from an illumination source 1302 and provide illumination an outer surface 1312.

More particularly, the illumination source 1302 may direct electromagnetic radiation into a longitudinal end 1316 of a core 1318 of the waveguide 1304. Accordingly, the electromagnetic radiation may be directed through the core 1318 of the waveguide 1304 along a longitudinal length thereof. The waveguide 1304 may be configured to restrict the spatial region in which electromagnetic radiation can propagate.

In this regard, the core 1318 of the waveguide 1304 may comprise a material defining a refractive index greater than that of air, and preferably equal to at least about 1.3. In this regard, by way of example, the core 1318 of the waveguide 1304 may comprise glass, plastic, crystal, or various other substantially transparent materials. By way of further example, the core 1318 of the waveguide 1304 may comprise an acrylic material or a polycarbonate polymer material in some embodiments. In another embodiment the core 1318 may comprise a substantially transparent metal material. For example, the core 1318 may comprise a transparent aluminum material, as available from Tera-Barrier Films of Singapore.

As a result of the core 1318 of the waveguide 1304 defining a refractive index greater than air (and the materials surrounding the core), the electromagnetic radiation may internally reflect such that the electromagnetic radiation is substantially constrained within the core of the waveguide. In this regard, internal reflection occurs when a ray of electromagnetic radiation passing through the core 1318 of the waveguide 1304 reaches a boundary (e.g., at an inner surface 1320 thereof) at which a medium of lower refractive index is encountered. However, when the propagation vector of the electromagnetic radiation is substantially normal to a surface of the core 1318 of the waveguide 1304, the electromagnetic radiation will exit the waveguide at such region. Thus, the waveguide 1304 may include one or more features configured to direct the electromagnetic radiation out of the core 1318 and toward the outer surface 1312 thereof by altering the propagation vector of the electromagnetic radiation to become substantially normal to the outer surface of the core of the waveguide.

Thus, the waveguide 1304 may be configured to retain the electromagnetic radiation within the core 1318 and propagate the electromagnetic radiation along the longitudinal length thereof except at specified locations where the electromagnetic radiation exits therefrom. In this regard, the features configured to direct the electromagnetic radiation out toward the outer surface 1312 may be selectively positioned to direct the electromagnetic radiation out of the core 1318 at desired locations. For example, a surface of the core 1318 of the waveguide 1304 may be roughened such that electromagnetic radiation incident thereon is directed to the outer surface 1312.

In the embodiment illustrated in FIG. 11, the waveguide 1304 comprises a roughened portion 1322 at the inner surface 1320 thereof at least partially surrounding the cavity 1314 that is configured to direct the electromagnetic radiation toward the outer surface 1312. The roughened portion 1322 may be formed by a variety of methods such as etching (e.g. chemical etching or laser etching). Various other methods and materials may be employed to form the roughened portion. For example, discrete prismatic structures may be embossed or molded within the waveguide or light scattering materials may be dispersed in a layer on a surface of the waveguide. Accordingly, the roughened portion 1322 of the waveguide 1304 may be sized and positioned to direct the electromagnetic radiation outwardly toward the outer surface 1312 at desired portions thereof. In this regard, the roughened portion 1322 may be provided at all or a portion of the inner surface 1320 along a continuous length or segmented portions of the waveguide 1304.

As illustrated in FIG. 11, the waveguide 1304 may additionally include an energy conversion material 1324. In one embodiment the energy conversion material 1324 may define a layer of material positioned on, or otherwise positioned outwardly from, the outer surface of the core 1318 of the waveguide 1304. For example, the energy conversion material 1324 may be printed, cast, coated, or otherwise coupled to the outer surface of the core 1318 of the waveguide 1304 and provided at all or a portion of the outer surface along a continuous length or segmented portions of the waveguide. The energy conversion material 1324 may comprise a phosphorescent or fluorescent photoluminescent material in some embodiments. In one embodiment the energy conversion material 1324 may comprise an organic fluorescent dye.

The energy conversion material 1324 may be configured to receive the electromagnetic radiation directed out of the core 1318 by the roughened portion 1322 and emit a secondary electromagnetic radiation differing in one or more respects from the original, primary electromagnetic radiation. In this regard, in one embodiment the energy conversion material 1324 may be configured to receive the electromagnetic radiation and emit a secondary electromagnetic radiation defining a wavelength differing from the wavelength of the primary electromagnetic radiation. The difference in wavelengths of the absorbed and emitted electromagnetic radiation may be referred to as a Stokes shift. In one embodiment the illumination source 1302 may comprise an LED configured to output visible light defining a relatively low wavelength (e.g., violet or blue light). Thereby, the energy conversion material 1324 may receive the light and emit light defining a higher wavelength and corresponding to a desired color. In this regard, by starting with light defining a relatively low wavelength, any color of light defining a higher wavelength may be created.

Multiple stacked layers of energy conversion materials may be configured to produce greater changes in wavelengths than the change caused by any one of the individual layers of energy conversion material. In this regard, each shift in wavelength between stacked layers of energy conversion layers may be additive and combine to define a greater wavelength shift. In an alternate embodiment, instead of employing absorption and emission between stacked layers of energy conversion materials, a Förster transfer mechanism may be employed whereby transfer of electronic energy occurs by dipolar coupling between first and second layers of energy conversion materials without requiring the emission of a photon by the first layer.

Although the energy conversion materials are generally described herein as altering a wavelength of the electromagnetic radiation emitted by the illumination source by absorption and emission, in other embodiments the energy conversion materials may alter a characteristic of the electromagnetic radiation emitted by the illumination source in a variety of other manners. For example, the energy conversion material may additionally or alternatively be configured to modulate electromagnetic energy by one or more of reflection and/or interference.

In some embodiments the energy conversion material may be configured to dynamically change the color of the illumination of the outer surface in response to stimuli such as stress, gas, heat, and/or wetness. In another embodiment the color of the illumination of the outer surface may be changed dynamically by employing multiple illumination sources. In this embodiment the illumination sources may be respectively configured to emit electromagnetic radiation defining differing wavelengths than at least one other illumination source. Additionally, or alternatively, the illumination sources may be configured to direct the electromagnetic radiation through an energy conversion material configured to alter the electromagnetic illumination in a differing manner. For example, a first illumination source may direct electromagnetic radiation through a first energy conversion material, and a second illumination source may direct electromagnetic radiation through a second energy conversion material configured to emit secondary electromagnetic radiation having a greater or lesser wavelength to result in differing illumination colors.

The waveguide 1304 may further comprise a reflective layer 1326. The reflective layer 1326 may be positioned inside or outside of the layer of the energy conversion material 1324. The reflective layer 1326 may be configured to reflect ambient light and prevent ambient light from entering the waveguide 1304. In one embodiment the reflective layer 1326 may comprise a metallic material. The reflective layer 1326 may hide the other portions of the waveguide 1304, such as the translucent or transparent core 1318. Accordingly, although the waveguide 1304 may be formed from materials such as a substantially clear plastic core 1318, the waveguide may appear to define a sold metal structure, which may be desirable to consumers. Although the reflective layer 1326 may substantially prevent ambient light from entering the waveguide 1304, the reflective layer may allow electromagnetic radiation emitted from the energy conversion material 1324 to provide illumination at the outer surface 1312.

In some embodiments the waveguide may further comprise one or more additional layers. In this regard, FIG. 12 illustrates a schematic view of the layers of an embodiment of waveguide 1304' including additional layers. As illustrated, the waveguide 1304' may include the transparent core 1318' with a roughened portion 1322' at an inner surface 1320'. Further, the waveguide 1304' may include one or more layers of energy conversion material 1324' and a reflective layer 1326' configured to block light directed toward an outer surface 1312' from entering through the waveguide 1304'. In some embodiments the one or more layers of energy conversion material 1324' may include multiple energy conversion materials defining differing properties, stacked layers of absorbing and emitting energy conversion materials, or layers of energy transfer materials defining a Förster transfer mechanism to create multiple colors of light, as described above. Additionally, multiple illumination sources and/or energy conversion materials configured to dynamically change the color of the illumination in response to stimuli such as stress, gas, heat, and/or wetness may be employed to dynamically change the color of the illumination.

The waveguide 1304' may further comprise an inner reflective layer 1350' configured to redirect any backscatter from the energy conversion material 1324' to the outer surface 1312' of the waveguide. The waveguide 1304' may further comprise a diffusion layer 1352' configured to scatter the electromagnetic radiation directed therethrough to provide a more diffuse illumination at the outer surface 1312' of the waveguide. Further, the waveguide 1304' may include a stability enhancement layer 1354' configured to prevent degradation of the energy conversion material 1324', which may otherwise occur when irradiated in the presence of air. The waveguide 1304' may additionally include a protective layer 1356' positioned outwardly from, and configured to protect, the remaining layers. In one example embodiment, the layers of the waveguide 1304' may be arranged in the order illustrated in FIG. 12. However, in other embodiments the layers of the waveguide may be arranged in other manners and/or a greater or lesser number of layers may be included. For example, in embodiments of the waveguide including the reflective layer 1326' configured to reflect ambient light (e.g., the outer reflective layer), this layer may be positioned inside or outside of the protective layer 1356'.

Various example of waveguides, energy conversion materials, reflective layers, diffusion layers, stability enhancement layers, and protective layers are described in U.S. Patent Application Publication Nos. 2012/0080613 and 2013/0088853 and U.S. Pat. Nos. 8,178,852 and 8,232,533, each to Kingsley et al., which are incorporated herein by reference in their entireties. Such waveguides, energy conversion materials, reflective layers, diffusion layers, stability enhancement layers and protective layers may also be commercially available from PERFORMANCE INDICATOR, LLC of Lowell, Mass.

The illumination source(s) and/or energy conversion material(s) may be configured to provide illumination at the outer surface of an aerosol delivery device in a variety of manners. Providing illumination at the outer surface, as used herein, refers to directing light to or through the outer surface of the aerosol delivery device. Thus, the light may be directed through the material defining the outer surface, or through apertures or other openings in the outer surface. As such, the illumination may be defined as being at, on, or through the outer surface. In this regard, illumination provided at the outer surface may define any color, in any pattern or arrangement, at any location thereon, with varying intensity using the principals and materials described above. For example, the outer surface may be illuminated to define a camouflage or modeled pattern, simulate a burning coal, simulate the aurora borealis, glow in the dark, and/or display a logo. Further, the one or more illumination source(s) and/or the waveguide may be configured to adjust illumination of the outer surface of the outer body based on a number of factors such as an electrical power source level, an aerosol precursor level, a temperature (e.g., an internal temperature of the heating element, a temperature of the waveguide, or an external temperature of the ambient air), an ambient light level, and a detected draw.

In some embodiments, the illumination may be adjusted passively. For example, the energy conversion material may glow in a different color in response to decreased ambient lighting or the energy conversion material may heat during use of the aerosol delivery device, causing the energy conversion material to alter the wavelength of the electromagnetic radiation to a differing extent. In other embodiments the illumination may be adjusted actively, for example by a controller. For example, the controller may direct one or both of the energy conversion layer and the illumination source(s) to adjust the illumination on the outer surface to define a ring (e.g., colored red) around the circumference of the aerosol delivery device that moves from the mouthend toward the distal end, and/or a color of the illumination may change. The controller may adapt the illumination in these and other manners as a function of one or more of the number of puffs on the aerosol delivery device, electrical power source level, aerosol precursor level, or one or more of various other factors. For example, one or more of the above-described flow sensor 220, a temperature sensor, a light sensor, a voltage or amperage sensor, and/or various other embodiments of sensors may be included in the aerosol delivery devices to provide the controller with the information regarding the status of the aerosol delivery device and/or the ambient environment.

Additionally or alternatively, the aerosol delivery device may provide for adjustment of the illumination in response to input from a user interface. In this regard, in some embodiments the user may actuate a button, capacitive sensor, switch, or other input mechanism on the aerosol delivery device to adjust the illumination. In another embodiment the illumination may be adjusted via an external controller. For example, a wired (e.g., USB) or wireless (e.g., Bluetooth) connection to a computing device such as a phone, tablet, or personal computer may be employed to direct a command from the computing device to define one or more parameters for the illumination.

Although the electromagnetic radiation described above is generally referenced as falling within the visible spectrum, in other embodiments one or both of the primary and secondary electromagnetic radiation may fall outside of the visible spectrum. For example, an illumination source may emit electromagnetic radiation outside of the visible spectrum, which may be converted to electromagnetic radiation within the visible spectrum by the energy conversion material in some embodiments. In another embodiment the energy conversion material may be configured to convert electromagnetic radiation within the visible spectrum, as emitted by an illumination source, to electromagnetic radiation falling outside the visible spectrum.

Returning to FIG. 7, one example embodiment of illumination of an outer surface 1012 of a waveguide 1004 is illustrated therein. As illustrated, the waveguide 1004 defines three illuminated sections 1025A-C, which may be illuminated using electromagnetic radiation emitted from the illumination source 1002. The illuminated sections 1025A-C correspond to the locations at which a roughened portion (see, e.g., the roughened portion 1322 in FIG. 11) or other feature directs the electromagnetic radiation emitted by the illumination source 1002 out of the core (see, e.g., the core 1318 in FIG. 11). By employing multiple energy conversion materials defining differing properties, stacked layers of absorbing and emitting energy conversion materials, or layers of energy transfer materials defining a Förster transfer mechanism, the color of the illuminated sections 1025A-C may differ. For example, the color of a first illuminated section 1025A may be yellow, the color of a second illuminated section 1025B may be orange, and the color of a third illuminated section 1025C may be red. However, the illuminated sections may define various other colors in various combinations in other embodiments.

Further, the color of the outer surface 1012 of the waveguide 1004 may also vary within an individual illuminated section in some embodiments. Thus, multiple colors may be displayed within an individual illuminated section. For example, the first illuminated section 1025A may define green and blue, or a combination of two or more other colors. Accordingly, in some embodiments a single illumination source 1002 may be employed with multiple energy conversion materials defining differing properties, stacked layers of absorbing and emitting energy conversion materials, or layers of energy transfer materials defining a Förster transfer mechanism to provide illumination at the outer surface 1012 with multiple colors of light. Use of a single illumination source 1002 may increase energy efficiency of the aerosol delivery device as compared to embodiments of apparatuses employing multiple illumination sources to respectively produce differing colors.

The illumination source 1002 may also be configured to provide illumination at a distal end 1028 of the waveguide 1004. In this regard, since the distal end 1028 of the waveguide 1004 may be substantially opposite to the location at which the illumination source 1002 is positioned, use of a roughened portion may not be required to direct the electromagnetic radiation therethough. More particularly, the illumination source 1002 may itself direct the electromagnetic radiation substantially perpendicularly to the distal end of the waveguide 1004. However, some or all of the various other layers and materials described above may be positioned at the distal end 1028 of the waveguide 1004 in order to control a wavelength of the electromagnetic radiation emitted therefrom and perform the other functions described above.

As described above and illustrated in FIGS. 7-11, in one embodiment the waveguide may comprise the outer body of the aerosol delivery device. However, in another embodiment, as illustrated in FIG. 13, a waveguide 1404 may be received within an outer body 1430. The waveguide 1404 may be provided as a single section or multiple sections, as described above. In one embodiment the outer body 1430 may comprise a metal material, such as steel or aluminum, but various other embodiments of materials such as plastics may be employed. One or more illumination sources 1402 may be coupled to, or embedded in the waveguide 1404, and controlled by a controller 1408 such that the electromagnetic radiation is directed into and through the waveguide and the outer surface 1432 of the outer body 1430 is illuminated, as discussed below.

FIG. 14 illustrates an exploded view of an embodiment of a control body 200" comprising the features and components of the control body 200 described above and illustrated in FIGS. 3-6. However, an outer body 1530 of the control body 200" may differ from the outer body 214 described above and the control body may further comprise a waveguide 1504 and at least one illumination source 1502. The waveguide 1504 may be configured to receive electromagnetic radiation from the illumination source 1502, direct electromagnetic radiation outwardly from an outer surface 1512 of the waveguide, and provide illumination at an outer surface 1532 of the outer body 1530.

The outer body 1530 may at least partially enclose the waveguide 1504 and components configured to atomize an aerosol precursor. In this regard, the outer body 1530 may define a cavity 1534 configured to at least partially enclose the waveguide 1504. Further, the waveguide 1504 may define a cavity 1514 configured to at least partially enclose one or more of the flow sensor 220, the control component 208, and the electrical power source 212. Note that although the control body 200" is illustrated as including the LED component 222 and the connector circuit 224, in other embodiments these components may not be included. In this regard, the waveguide 1504 may be configured to provide illumination at the end cap 216 or other portion(s) of the control body 200" proximate the end cap in the manner described above. For example, the control body 200" may be configured such that an end of the waveguide 1504 distal from the illumination source 1502 is exposed such that light directed thereto is externally visible.

In an additional embodiment, the waveguide may be received within the outer body of a cartridge of an aerosol delivery device, in addition to or instead of a waveguide being received within the outer body of the control body. In this regard, FIG. 15 illustrates an exploded view of a cartridge 400" comprising the features and components of the cartridge 400 described above and illustrated in FIG. 2. However, instead of the outer body 416, the cartridge 400" may include an outer body 1630, a waveguide 1604, and at least one illumination source 1602. Thus, the waveguide 1604 may receive electromagnetic radiation from the illumination source 1602, direct electromagnetic radiation outwardly from an outer surface 1612 of the waveguide, and provide illumination at an outer surface 1632 of the outer body 1630. Note that the embodiment of the cartridge 400" illustrated in FIG. 15 does not include the label 418. Accordingly, illumination of the outer surface 1632 of the waveguide 1604 may be visible. However, in other embodiments the cartridge may include the label, and the label may be translucent or transparent, or the label may include gaps or holes at locations at which the cartridge is illuminated. The outer body 1630 may define a cavity 1634 configured to at least partially enclose the waveguide 1604. Further, the waveguide 1604 may define a cavity 1614 configured to at least partially enclose components configured to atomize an aerosol precursor. In this regard, the waveguide 1604 may at least partially enclose the electronic control component 408, the flow tube 410, the atomizer 412, and the reservoir substrate 414.

An end view of an embodiment of an outer body 1730 and a waveguide 1704 received in a cavity 1734 defined by the outer body are illustrated in FIG. 16. The outer body 1730 and the waveguide 1704 may comprise portions of an aerosol device. In this regard, the end view of the waveguide 1304 may be substantially similar to an end view of the outer bodies 1530, 1630 and waveguides 1504, 1604 employed in the control body 200" and cartridge 400" illustrated in FIGS. 14 and 15. The waveguide 1704 may be configured to receive electromagnetic radiation from an illumination source 1702 and provide illumination at an outer surface 1732 of the outer body 1730.

In this regard, the waveguide 1704 may function in substantially the same manner as described above. Briefly, however, electromagnetic radiation emitted from the illumination source 1702 at a longitudinal end 1716 of a core 1718 of the waveguide 1704 may be constrained therein and directed along the longitudinal length thereof. However, a roughened portion 1722 at an inner surface 1720 of the waveguide 1704 surrounding a cavity 1714 may direct the electromagnetic radiation radially outwardly toward the outer body 1730. The roughened portion 1722 may be provided at all or a portion of the inner surface 1720 along a continuous length or segmented portions of the waveguide 1704. The electromagnetic radiation may thus be directed toward a layer of an energy conversion material 1724. As described above, the energy conversion material 1724 may absorb the electromagnetic radiation and emit a secondary electromagnetic radiation defining a wavelength or other characteristic differing from that of the original, primary electromagnetic radiation. In some embodiments the energy conversion material 1724 may be provided along a continuous length or one or more portions along the length of the waveguide 1704.

However, the waveguide 1704 may differ in that it may be at least partially received in the outer body 1730. Since the waveguide 1704 is at least partially concealed by the outer body 1730, the waveguide may not employ a reflective layer configured to reflect ambient light. However, as a result of the outer body 1730 at least partially surrounding the waveguide 1704, the outer body may include features configured to allow for illumination of the outer body using the electromagnetic radiation exiting the waveguide. In this regard, as illustrated in FIG. 16, the outer body 1730 may include one or more apertures 1736 extending therethrough to the outer surface 1732. The one or more apertures 1736 may be formed from a variety of processes such as chemical etching, laser etching, machining, etc. Accordingly, electromagnetic radiation (e.g., the secondary electromagnetic radiation emitted from the energy conversion material 1724 may travel through the apertures 1736 to provide illumination at the outer surface 1732 of the outer body 1730. Alternatively, the outer body may be clear or translucent. Accordingly, the outer surface of aerosol delivery devices may be illuminated regardless of whether the outer surface is defined by the waveguide itself or a separate outer body in which the waveguide is received.

In some embodiments the waveguide may further comprise one or more additional layers. In this regard, FIG. 17 illustrates a schematic view of the layers of an embodiment of waveguide 1704' including additional layers. As illustrated, the waveguide 1704' may include the transparent core 1718' with a roughened portion 1722' at an inner surface 1720'. Further, the waveguide 1704' may include one or more layers of energy conversion material 1724' received within a cavity 1734' defined by an outer body 1730' including apertures 1736' extending therethrough. In some embodiments the one or more layers of energy conversion material 1724' may include multiple energy conversion materials defining differing properties, stacked layers of absorbing and emitting energy conversion materials, or layers of energy transfer materials defining a Förster transfer mechanism to create multiple colors of light, as described above. Additionally, multiple illumination sources and/or energy conversion materials configured to dynamically change the color of the illumination in response to stimuli such as stress, gas, heat, and/or wetness may be employed to dynamically change the color of the illumination.

The waveguide 1704' may further comprise an inner reflective layer 1750' configured to redirect any backscatter from the energy conversion material 1724' toward the outer body 1730' of the waveguide. The waveguide 1704' may further comprise a diffusion layer 1752' configured to scatter the electromagnetic radiation directed therethrough to provide a more diffuse illumination at an outer surface 1732' of the outer body 1730'. Further, the waveguide 1704' may include a stability enhancement layer 1754' configured to prevent degradation of the energy conversion material 1724', which may otherwise occur when irradiated in the presence of air. In one example embodiment, the layers of the waveguide 1704' may be arranged in the order illustrated in FIG. 17. However, in other embodiments the layers of the waveguide may be arranged in other manners and/or a greater or lesser number of layers may be included. For example, the waveguide may additionally include a protective layer positioned outwardly from, and configured to protect, the remaining layers inside of the outer body. However, in some embodiments the protective layer may be omitted due to the outer body 1730' providing protection for the other layers.

Various example of waveguides, energy conversion materials, reflective layers, diffusion layers, stability enhancement layers, and protective layers are described in U.S. Patent Application Publication Nos. 2012/0080613 and 2013/0088853 and U.S. Pat. Nos. 8,178,852 and 8,232,533, each to Kingsley et al., which are incorporated herein by reference in their entireties. Such waveguides, energy conversion materials, reflective layers, diffusion layers, stability enhancement layers and protective layers may also be commercially available from PERFORMANCE INDICATOR, LLC of Lowell, Mass. Note that a separate controller configured to direct the illumination source to output electromagnetic radiation is not illustrated in FIGS. 9-11 and 14-16. In this regard, it should be understood that the controller may be positioned in a variety of locations within the control body and/or the cartridge of an aerosol delivery device. Further, in some embodiments the control component configured to control operation of the atomizer may also be configured to control operation of the illumination source(s). Thus, a single controller may be configured to control multiple functions in one embodiment. However, a separate controller may be employed to control the illumination source(s) in other embodiments.

As briefly noted above, in some embodiments the control bodies described herein may be rechargeable. For example, an adaptor including a USB connector at one end and a control body connector at an opposing end is disclosed in U.S. patent application Ser. No. 13/840,264, filed Mar. 15, 2013, which is incorporated herein by reference in its entirety. The control body connector may be configured to match the shape of a base of a cartridge to which a control body is configured to engage. Thus, when the USB connector of the adaptor is plugged into an appropriate receptacle and the control body connector is plugged into a control body, the electrical power source (e.g., a battery) of the control body may be charged.

Further, in some embodiments the adaptor may be configured to transfer data to, or receive data from, the controller(s) of the aerosol delivery device. For example, the adaptor may be configured to transfer data from an aerosol delivery device to a computing device relating to usage of the aerosol delivery device. Further, data may be transferred from a computing device through the adaptor to the aerosol delivery device. For example, the controller controlling the illumination source(s) may be provided with data instructing the controller to implement a new display scheme providing illumination at the outer surface of the aerosol delivery device. Thereby, for example, a user may customize illumination of the outer surface of the aerosol delivery device.

A method for illuminating an aerosol delivery device is also provided. As illustrated in FIG. 18, the method may comprise providing an aerosol delivery device at operation 1900. The aerosol delivery device may comprise one or more components configured to atomize an aerosol precursor composition, an outer body at least partially enclosing the components, one or more illumination sources, and a waveguide in some embodiments. The method may further comprise outputting an electromagnetic radiation with the one or more illumination sources at operation 1902. Additionally, the method may include directing the electromagnetic radiation through the waveguide at operation 1904. Further, the method may include providing illumination at an outer surface of the outer body at operation 1906.

In some embodiment the outer body comprises the waveguide. In this regard, the method may further comprise reflecting an ambient light with a reflective layer of the waveguide at operation 1908. In another embodiment the waveguide may be received within the outer body. In this regard, providing illumination at the outer surface of the body at operation 1906 may comprise directing the electromagnetic radiation toward one or more apertures defined in the outer body.

Further, in some embodiments directing the electromagnetic radiation through the waveguide at operation 1904 may comprise directing the electromagnetic radiation to a roughened portion of the waveguide. Additionally, directing the electromagnetic radiation through the waveguide at operation 1904 may comprise directing the electromagnetic radiation to an energy conversion material configured to emit a secondary electromagnetic radiation defining a wavelength differing from a wavelength of the electromagnetic radiation. Outputting the electromagnetic radiation at operation 1902 may comprise selectively outputting the electromagnetic radiation at a plurality of sections of the waveguide from a respective one of the illumination sources. Also, providing illumination at the outer surface of the outer body at operation 1902 may comprise providing illumination at the outer surface of a control body, wherein the components comprise an electrical power source and a control component, the control component being configured to selectively direct an atomizer to atomize an aerosol precursor. In an additional embodiment providing illumination at the outer surface of the outer body at operation 1902 may comprise providing illumination at the outer surface of a cartridge, wherein the components comprise a reservoir substrate configured to hold an aerosol precursor composition and an atomizer configured to produce heat. The method may further comprise adjusting illumination of the outer surface of the outer body based on at least one of an electrical power source level, an aerosol precursor level, a temperature, an ambient light level, and a detected draw at operation 1910.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device, comprising:

one or more components configured to atomize an aerosol precursor composition;

an outer body at least partially enclosing the components;

one or more illumination sources configured to output an electromagnetic radiation; and a waveguide configured to receive the electromagnetic radiation from the one or more illumination sources and provide illumination at an outer surface of the outer body, at least one of the one or more illumination sources being positioned outside of the waveguide and coupled to a longitudinal end thereof.

2. The aerosol delivery device of claim 1, wherein the outer body comprises the waveguide.

3. The aerosol delivery device of claim 2, wherein the waveguide comprises a reflective layer configured to reflect an ambient light.

4. The aerosol delivery device of claim 1, wherein the waveguide is received within the outer body.

5. The aerosol delivery device of claim 4, wherein the outer body defines one or more apertures extending therethrough to the outer surface.

6. The aerosol delivery device of claim 1, wherein the waveguide comprises a roughened portion configured to direct the electromagnetic radiation toward the outer surface.

7. The aerosol delivery device of claim 1, wherein the waveguide comprises an energy conversion material configured to receive the electromagnetic radiation and emit a secondary electromagnetic radiation defining a wavelength differing from a wavelength of the electromagnetic radiation.

8. The aerosol delivery device of claim 1, wherein the waveguide comprises a plurality of sections, each of the sections having one of the illumination sources associated therewith.

9. The aerosol delivery device of claim 1, wherein the outer body comprises the outer body of a control body and the components comprise an electrical power source and a control component, the control component being configured to selectively direct an atomizer to atomize an aerosol precursor.

10. The aerosol delivery device of claim 1, wherein the outer body comprises the outer body of a cartridge and the components comprise a reservoir substrate configured to hold an aerosol precursor composition and an atomizer configured to produce heat.

11. The aerosol delivery device of claim 1, wherein at least one of the waveguide and the one or more illumination sources are configured to adjust illumination at the outer surface of the outer body based on at least one of an electrical power source level, an aerosol precursor level, a temperature, an ambient light level, and a detected draw.

12. The aerosol delivery device of claim 1, wherein the device is an electronic smoking article.

13. A method for illuminating an aerosol delivery device, comprising:

providing an aerosol delivery device, comprising:

one or more components configured to atomize an aerosol precursor composition;

an outer body at least partially enclosing the components;

one or more illumination sources; and a waveguide, at least one of the one or more illumination sources being positioned outside of the waveguide and coupled to a longitudinal end thereof;

outputting an electromagnetic radiation with the one or more illumination sources;

directing the electromagnetic radiation through the waveguide; and providing illumination at an outer surface of the outer body.

14. The method of claim 13, wherein the outer body comprises the waveguide.

15. The method of claim 14, further comprising reflecting an ambient light with a reflective layer of the waveguide.

16. The method of claim 13, wherein the waveguide is received within the outer body.

17. The method of claim 16, wherein providing illumination at the outer surface of the body comprises directing the electromagnetic radiation toward one or more apertures defined in the outer body.

18. The method of claim 13, wherein directing the electromagnetic radiation through the waveguide comprises directing the electromagnetic radiation to a roughened portion of the waveguide.

19. The method of claim 13, wherein directing the electromagnetic radiation through the waveguide comprises directing the electromagnetic radiation to an energy conversion material configured to emit a secondary electromagnetic radiation defining a wavelength differing from a wavelength of the electromagnetic radiation.

20. The method of claim 13, wherein outputting the electromagnetic radiation comprises selectively outputting the electromagnetic radiation at a plurality of sections of the waveguide from a respective one of the illumination sources.

21. The method of claim 13, wherein providing illumination at the outer surface of the outer body comprises providing illumination at the outer surface of a control body, wherein the components comprise an electrical power source and a control component, the control component being configured to selectively direct an atomizer to atomize an aerosol precursor.

22. The method of claim 13, wherein providing illumination at the outer surface of the outer body comprises providing illumination at the outer surface of a cartridge, wherein the components comprise a reservoir substrate configured to hold an aerosol precursor composition and an atomizer configured to produce heat.

23. The method of claim 13, further comprising adjusting illumination of the outer surface of the outer body based on at least one of an electrical power source level, an aerosol precursor level, a temperature, an ambient light level, and a detected draw.

24. The method of claim 13, wherein the aerosol delivery device is an electronic smoking article.

* * * * *